US008529288B2

(12) United States Patent
Montena et al.

(10) Patent No.: US 8,529,288 B2
(45) Date of Patent: Sep. 10, 2013

(54) COVER FOR CABLE CONNECTORS

(75) Inventors: Noah Montena, Syracuse, NY (US); Christopher P. Natoli, Fulton, NY (US)

(73) Assignee: John Mezzalingua Associates, LLC, East Syracuse, NY (US)

( * ) Notice: Subject to any disclaimer, the term of this patent is extended or adjusted under 35 U.S.C. 154(b) by 0 days.

(21) Appl. No.: 13/248,789

(22) Filed: Sep. 29, 2011

(65) Prior Publication Data

US 2012/0190234 A1 Jul. 26, 2012

Related U.S. Application Data

(63) Continuation of application No. PCT/US2010/050708, filed on Sep. 29, 2010, which is a continuation-in-part of application No. 12/760,134, filed on Apr. 14, 2010.

(51) Int. Cl.
*H01R 13/52* (2006.01)

(52) U.S. Cl.
USPC ..... 439/523

(58) Field of Classification Search
USPC ..... 439/488, 521, 125, 447, 523; 174/138 F
See application file for complete search history.

(56) References Cited

U.S. PATENT DOCUMENTS

| | | | | | |
|---|---|---|---|---|---|
| 1,921,447 | A | * | 8/1933 | Barnett | 439/447 |
| 1,965,151 | A | * | 7/1934 | Mueller | 439/744 |
| 2,323,399 | A | * | 7/1943 | Jacobi | 174/397 |
| 2,458,153 | A | * | 1/1949 | Festge | 439/272 |
| 2,550,358 | A | * | 4/1951 | Le Grand et al. | 174/77 S |
| 2,665,673 | A | * | 1/1954 | Woofter | 439/125 |
| 2,755,449 | A | | 7/1956 | Anderson | |
| 2,881,406 | A | | 4/1959 | Arson | |
| 2,930,022 | A | | 3/1960 | Webster | |
| 2,946,839 | A | | 7/1960 | Horning | |
| 3,120,987 | A | | 2/1964 | Degnan et al. | |
| 3,155,448 | A | * | 11/1964 | Korsgren, Jr. | 439/271 |
| 3,251,020 | A | | 5/1966 | Coleman | |
| 3,390,375 | A | | 6/1968 | Salmonson | |
| 3,528,051 | A | | 9/1970 | Cooper | |
| 3,571,782 | A | * | 3/1971 | Colbert et al. | 439/523 |
| 3,710,307 | A | | 1/1973 | Cooper, Jr. | |

(Continued)

FOREIGN PATENT DOCUMENTS

| | | | |
|---|---|---|---|
| EP | 0637116 | A1 | 2/1995 |
| EP | 0872915 | A2 | 10/1998 |
| EP | 1249897 | A1 | 10/2002 |
| GB | 2019665 | A | 10/1979 |

OTHER PUBLICATIONS

U.S. Appl. No. 29/376,585, filed Oct. 8, 2010.
U.S. Appl. No. 29/381,622, filed Dec. 21, 2010.

(Continued)

*Primary Examiner* — Neil Abrams
(74) *Attorney, Agent, or Firm* — Schmeiser, Olsen & Watts LLP

(57) ABSTRACT

A cover and a system of covers/boots for placement in sealed relation over a connector or pair of connectors that is or are adapted to terminate a cable or splice together a pair of cables, preferably cables that carry signals received by a receiving apparatus on a cell tower. The covers include a cable end that sealingly receives a cable therein, an elongated body that provides secure cover to a cable connector, and an end that abuts a bulkhead or sealingly engages with a second cover when used in a splicing application.

4 Claims, 35 Drawing Sheets

(56) References Cited

U.S. PATENT DOCUMENTS

| | | | | | |
|---|---|---|---|---|---|
| 3,713,077 | A | | 1/1973 | Leonard | |
| 3,753,192 | A | | 8/1973 | Urani | |
| 3,792,415 | A | | 2/1974 | Fuller | |
| 3,861,777 | A | | 1/1975 | Clark | |
| 3,874,760 | A | * | 4/1975 | Guthmiller et al. | 439/588 |
| 4,173,385 | A | | 11/1979 | Fenn et al. | |
| 4,192,566 | A | | 3/1980 | Laudig et al. | |
| 4,224,464 | A | | 9/1980 | Bunnell et al. | |
| 4,283,597 | A | | 8/1981 | Cooper, Jr. | |
| 4,325,600 | A | | 4/1982 | Nestor | |
| 4,391,481 | A | * | 7/1983 | Golden | 439/141 |
| 4,421,369 | A | | 12/1983 | Myking | |
| 4,576,428 | A | * | 3/1986 | DeLuca et al. | 439/271 |
| 4,593,962 | A | | 6/1986 | Knorreck et al. | |
| 4,614,392 | A | | 9/1986 | Moore | |
| 4,647,135 | A | | 3/1987 | Reinhardt | |
| 4,822,293 | A | | 4/1989 | Robson | |
| 4,869,679 | A | | 9/1989 | Szegda | |
| 4,915,990 | A | | 4/1990 | Chang | |
| 4,985,002 | A | | 1/1991 | Maisch et al. | |
| 4,998,894 | A | | 3/1991 | Gronvall | |
| 5,006,078 | A | * | 4/1991 | Crandall et al. | 439/521 |
| 5,057,971 | A | * | 10/1991 | Hautvast et al. | 361/740 |
| 5,132,495 | A | | 7/1992 | Ewing et al. | |
| 5,297,971 | A | * | 3/1994 | Nitta et al. | 439/125 |
| 5,299,951 | A | | 4/1994 | Blaetz | |
| 5,338,211 | A | * | 8/1994 | Kodama et al. | 439/135 |
| 5,397,243 | A | * | 3/1995 | MacMurdo, Sr. | 439/136 |
| 5,401,184 | A | * | 3/1995 | Sundstrom et al. | 439/367 |
| 5,448,017 | A | * | 9/1995 | Nakajima et al. | 174/152 G |
| 5,487,680 | A | * | 1/1996 | Yamanashi | 439/552 |
| 5,502,280 | A | | 3/1996 | Rocci et al. | |
| 5,564,951 | A | | 10/1996 | Attal et al. | |
| 5,586,909 | A | * | 12/1996 | Saba | 439/559 |
| 5,616,046 | A | * | 4/1997 | Sundstrom et al. | 439/367 |
| 5,816,853 | A | | 10/1998 | Buekers et al. | |
| 5,844,171 | A | | 12/1998 | Fitzgerald | |
| 5,857,865 | A | | 1/1999 | Shimirak et al. | |
| 5,857,873 | A | | 1/1999 | Castaldo | |
| 5,886,294 | A | | 3/1999 | Scrimpshire et al. | |
| 6,007,378 | A | | 12/1999 | Oeth | |
| 6,109,945 | A | | 8/2000 | Creelle et al. | |
| 6,132,250 | A | | 10/2000 | Shinozaki et al. | |
| 6,162,087 | A | | 12/2000 | Hiura | |
| 6,203,354 | B1 | | 3/2001 | Kuwahara et al. | |
| 6,273,733 | B1 | | 8/2001 | Uchiyama | |
| 6,305,945 | B1 | | 10/2001 | Vance | |
| 6,336,821 | B1 | | 1/2002 | Hattori | |
| 6,558,180 | B2 | | 5/2003 | Nishimoto | |
| 6,592,384 | B2 | * | 7/2003 | Sawayanagi | 439/157 |
| 6,652,289 | B2 | * | 11/2003 | Bae | 439/34 |
| 6,752,655 | B1 | * | 6/2004 | Kaczmarek | 439/546 |
| 6,840,789 | B2 | * | 1/2005 | Shibata | 439/345 |
| 6,887,105 | B2 | | 5/2005 | Knighten et al. | |
| 6,929,265 | B2 | | 8/2005 | Holland et al. | |
| 6,942,520 | B2 | | 9/2005 | Barlian et al. | |
| 7,001,202 | B2 | | 2/2006 | Robbins | |
| 7,056,151 | B2 | | 6/2006 | Cawood et al. | |
| 7,128,605 | B2 | * | 10/2006 | Montena | 439/578 |
| 7,179,100 | B2 | | 2/2007 | Montena | |
| 7,186,127 | B2 | | 3/2007 | Montena | |
| 7,195,505 | B1 | | 3/2007 | Becker | |
| 7,216,426 | B2 | | 5/2007 | Borgstrom et al. | |
| 7,311,563 | B2 | * | 12/2007 | Siebens et al. | 439/781 |
| 7,402,063 | B2 | | 7/2008 | Montena | |
| 7,407,412 | B2 | | 8/2008 | Khemakhem | |
| 7,632,141 | B2 | * | 12/2009 | Malak | 439/578 |
| 7,726,996 | B2 | * | 6/2010 | Burris et al. | 439/271 |
| 7,731,512 | B1 | | 6/2010 | Montena et al. | |
| 7,767,908 | B2 | * | 8/2010 | Sylvan | 174/74 R |
| 7,838,775 | B2 | | 11/2010 | Montena | |
| D631,848 | S | | 2/2011 | Montena et al. | |
| D642,538 | S | | 8/2011 | Montena et al. | |
| D642,988 | S | | 8/2011 | Montena et al. | |
| D642,989 | S | | 8/2011 | Montena et al. | |
| D642,990 | S | | 8/2011 | Montena et al. | |
| D643,372 | S | | 8/2011 | Montena et al. | |
| D646,227 | S | | 10/2011 | Natoli | |
| 8,062,045 | B2 | | 11/2011 | Montena | |
| D656,101 | S | | 3/2012 | Montena et al. | |
| D659,102 | S | | 5/2012 | Natoli | |
| D664,100 | S | | 7/2012 | Montena et al. | |
| 8,337,228 | B1 | * | 12/2012 | Montena | 439/277 |
| 8,419,467 | B2 | * | 4/2013 | Montena | 439/523 |
| 2004/0245730 | A1 | | 12/2004 | Holland et al. | |
| 2006/0035508 | A1 | | 2/2006 | Stekelenburg | |
| 2006/0286862 | A1 | | 12/2006 | Lubinsky et al. | |
| 2011/0059662 | A1 | | 3/2011 | Montena | |
| 2011/0230083 | A1 | | 9/2011 | Anderson et al. | |
| 2011/0256755 | A1 | | 10/2011 | Montena | |
| 2012/0009830 | A1 | | 1/2012 | Montena | |
| 2012/0214335 | A1 | | 8/2012 | Natoli et al. | |

OTHER PUBLICATIONS

U.S. Appl. No. 29/376,066, filed Oct. 1, 2010.
U.S. Appl. No. 29/376,068, filed Oct. 1, 2010.
U.S. Appl. No. 29/387,881, filed Mar. 19, 2011.
U.S. Appl. No. 13/237,563, filed Sep. 20, 2011.
U.S. Appl. No. 13/150,682, filed Jun. 1, 2011.
Notice of Allowance (Mail Date: Jul. 13, 2011) for U.S. Appl. No. 12/945,525, filed Nov. 12, 2010.
Office Action (Mail Date: Feb. 18, 2011) for U.S. Appl. No. 12/945,525, filed Nov. 12, 2010.
EP10182355 Extended European Search Report. Date of Completion Dec. 6, 2010. 9 pp.
PCT/US2010/050708 filed Sep. 29, 2010; International Search Report and Written Opinion. Date of Mailing: Jun. 29, 2011. 11 pp.
Office Action (Mail Date Dec. 15, 2011) for U.S. Appl. No. 12/760,134, filed Apr. 4, 2010.
CIP U.S. Appl. No. 13/401,835, filed Feb. 21, 2012.
Office Action (Mail Date Aug. 20, 2012) for U.S. Appl. No. 12/760,134, filed Apr. 4, 2010.
Final Office Action (Mail Date Apr. 25, 2012) for U.S. Appl. No. 12/760,134, filed Apr. 4, 2010.
U.S. Appl. No. 13/723,859, filed Dec. 21, 2012.
Notice of Allowance (Mail Date: Dec. 14, 2012) for U.S. Appl. No. 12/760,134, filed Apr. 14, 2010.

* cited by examiner

COVER FOR CABLE CONNECTORS

CROSS-REFERENCE TO RELATED APPLICATIONS

This application is a continuation of PCT/US2010/050708 filed Sep. 29, 2010, which is a continuation-in-part application claiming priority to U.S. application Ser. No. 12/760,134 filed Apr. 14, 2010, entitled "COVER FOR CABLE CONNECTORS", the entire contents of which are incorporated herein by reference. The present application is related to United States Non-provisional application Ser. No. 12/414,255 entitled "Cover for Cable Connectors" filed Mar. 30, 2009, the entire contents of which are incorporated herein by reference.

BACKGROUND OF THE INVENTION

1. Field of the Invention

The present invention relates generally to covers for cable connectors, and more particularly to covers that protect cable connectors from environmental degradation.

2. Description of the Related Art

Transmission line components such as connectors are often exposed to the open environment and are thus susceptible to degradation from weather related corrosive effects (e.g., moisture infiltration), pollution, debris and other elements. Degradation of the components potentially leads to degradation of the signal quality being transmitted through the cables.

To protect the components from environmental effects, layers of tape have been used to cover and seal the components, creating what have conventionally been referred to as tape-wrap seals. The tape layers typically consist of a first layer of electrical tape, followed by a layer of butyl tape, and then followed by another layer of electrical tape. While the layering of tape does in certain instances provide for a secure seal, it is not without its drawbacks.

First, the taping requires significant time in its initial installation, and needs to be removed in order to gain access to the component when servicing the components (and then reapplied after servicing is complete). The time associated with the taping and removal thereof when servicing the components is costly. In addition, the quality of the seal is dependant on the skill of the worker that is applying the tape. As such, inconsistent application of the tape may lead to instances of ineffective sealing of components.

Second, the properties inherent in the material composition of the tape subjects the tape to size fluctuation and inconsistent adherence. If the tape contracts in colder temperatures and loses adherence strength in warmer temperatures, for example, the quality of the seal created through the tape becomes compromised in regions that experience wide temperature fluctuation. In addition, the same pollutants and other environmental factors that affect the components when unsealed may also affect the sealing quality of the tape.

In addition to taping as a sealing provision, plastic clamshell or valise type covers have been used to envelop the components. These style covers are exemplified by the plastic material composition and the closure mechanisms used to open and close them around the components. While the opening and closing of the clamshell style cover facilitates quicker installation and removal in repair situations, it too is not without its drawbacks. For instance, the plastic material becomes brittle in colder temperatures, and this reduction in ductility increases over time. As the material becomes more brittle, the closure mechanisms lose their effectiveness often breaking or otherwise not reliably performing the closure function for which they were designed. Furthermore, the clamshell style closures include seams that extend essentially the entire periphery of the cover, making the sealing function much more difficult when compared to covers that do not include such long seams between parts. As such, the clamshell style covers lose their sealing effectiveness over time and in climates that routinely experience cold temperatures.

There is also a need for protective elements such as cable covers that are designed to cover and protect transmission line components such as connectors which are angled or otherwise variable.

SUMMARY OF THE INVENTION

It is therefore a principal object and advantage of the present invention to provide a cover for cable connectors or other components that may be quickly installed and/or removed.

It is another object and advantage of the present invention to provide a cable component cover that protects the cable connectors or other components from the environment.

It is yet another object and advantage of the present invention to provide a cable component cover that maintains its sealing properties regardless of temperature fluctuations.

It is a further object and advantage of the present invention to provide a cable connector cover that may be used in conjunction with other cable connector covers of various sizes and/or shapes.

Other objects and advantages of the present invention will in part be obvious, and in part appear hereinafter.

In accordance with the foregoing objects and advantages, a first aspect of the present invention provides a cover for a connector adapted to terminate a cable, wherein the connector includes a body portion and a coupling element. The cover comprises: (i) a unitary elongated body member having a cable end, a bulkhead end, an interior surface, and an exterior surface, where the unitary elongated body extends along a longitudinal axis; (ii) a plurality of spaced apart grooves formed in a predetermined region of the interior surface of the body member, proximate the cable end; and (iii) wherein the interior surface of the body member is adapted to sealingly engage the connector in an area proximate the bulkhead end. The cover is composed of a rubber material, preferably a silicone rubber. The exterior surface of the cover can include at least one wing formed on the exterior surface that serves as a gripping surface for a tool or manual engagement (e.g., fingers) used to remove the cover from a connector by axial sliding of the cover. The cover can further include an adaptor that is in removable communication with the cover and is preferably composed of a plastic material. At least a portion of the adaptor is positioned between the connector and the interior surface of the cover. The cover can further include an annular ridge that is formed to forcibly fit over the connector.

A second aspect of the present invention provides a cover for a connector adapted to terminate a cable, the cover comprising: (i) a unitary elongated body member having a cable end, a connector end, an interior surface, and an exterior surface, where the unitary elongated body extends along a longitudinal axis; and (ii) wherein the exterior surface comprises a first region extending from the cable end to a first shoulder and including at least one strain relief member defined therein, the first region having a minimum, first cross-sectional diameter, a second region extending from the first shoulder to a second shoulder, the second region having a minimum, second cross-sectional diameter that is less than the minimum, first cross-sectional diameter, and a third region extending from the second shoulder to the connector end, the third region having a minimum, third cross-sectional diameter that is greater than the minimum, second cross-sectional diameter. Each of the strain members comprise a circumferential groove extending less than completely around the circumference of said first region of the exterior surface. The cover can optionally include a plurality of spaced-apart grooves in one of the interior regions, preferably the interior region proximate the cable end. Each of the grooves extend in spaced parallel relation to the others.

A third aspect of the present invention provides a cover for a connector adapted to terminate a cable, the cover comprising: (i) a unitary elongated body member having a cable end, a connector end, an interior surface, and an exterior surface, the unitary elongated body extending along a longitudinal axis; and (ii) wherein the interior surface comprises a first region adapted to cover at least a portion of the cable and extending from the cable end to a first shoulder, the first region having a minimum, first cross-sectional diameter, and a second region adapted to cover at least the connector body portion and that extends from the first shoulder to a second shoulder, the second region having a minimum, second cross-sectional diameter that is greater than the minimum, first cross-sectional diameter. The exterior surface of the cover can optionally comprise a first region extending from the cable end to a third shoulder and include at least one strain relief member defined therein, the first region having a minimum, third cross-sectional diameter, a second region extending from the third shoulder to a fourth shoulder, the second region having a minimum, fourth cross-sectional diameter that is less than the minimum, third cross-sectional diameter, and a third region extending from the fourth shoulder to the connector end, the third region having a minimum, fifth cross-sectional diameter that is greater than the minimum, fourth cross-sectional diameter.

A fourth aspect of the present invention provides a cover for a connector adapted to terminate a cable, the cover comprising: (i) a unitary elongated body member having a cable end, a connector end, an interior surface, and an exterior surface, the unitary elongated body extending along a longitudinal axis; and (ii) wherein the interior surface includes a first region extending from the cable end to a first shoulder, the first region being of a minimum, first cross-sectional diameter, a second region extending from the first shoulder to a second shoulder, the second region being of an minimum, second cross-sectional diameter that is greater than the minimum, first cross-sectional diameter, and a third region extending from the second shoulder to the connector end, the third region being of a minimum, third cross-sectional diameter that is greater than the minimum, second cross-sectional diameter. The cover can optionally further comprise: (iii) wherein the exterior surface comprises a first region extending from the cable end to a third shoulder and including at least one strain relief member defined therein, the first region having a minimum, fourth cross-sectional diameter, a second region extending from the third shoulder to a fourth shoulder, the second region having a minimum, fifth cross-sectional diameter that is less than the minimum, fourth cross-sectional diameter, and a third region extending from said fourth shoulder to the connector end, the third region having a minimum, sixth cross-sectional diameter that is greater than the minimum, fifth cross-sectional diameter.

A fifth aspect of the present invention provides a cover for a connector adapted to terminate a cable, the cover comprising: (i) a unitary elongated body member having a cable end, a connector end, an interior surface, and an exterior surface, said unitary elongated body extending along a longitudinal axis; (ii) wherein said interior surface includes a first region adapted to cover at least a portion of the signal carrying cable and extending from said cable end to a first shoulder, said first region being of a minimum, first cross-sectional diameter, a second region adapted to cover at least the connector body portion and that extends from said first shoulder to a second shoulder, said second region being of an minimum, second cross-sectional diameter that is greater than said minimum, first cross-sectional diameter, a third region adapted to cover at least the coupling element and extending from said second shoulder to a third shoulder, said third region being of a minimum, third cross-sectional diameter that is larger than said second cross-sectional diameter, and a fourth region adapted to cover the shank portion and that extends from said third shoulder to said connector end, said fourth region being of a minimum, fourth cross-sectional diameter that is greater than said minimum, third cross-sectional diameter. The cover can optionally further comprise: (iii) wherein the exterior surface comprises a first region extending from the cable end to a fourth shoulder and including at least one strain relief member defined therein, the first region having a minimum, fifth cross-sectional diameter, a second region extending from the fourth shoulder to a fifth shoulder, the second region having a minimum, sixth cross-sectional diameter that is less than the minimum, fifth cross-sectional diameter, and a third region extending from the fifth shoulder to the connector end, the third region having a minimum, seventh cross-sectional diameter that is greater than the minimum, sixth cross-sectional diameter.

A sixth aspect of the present invention provides a system for covering a first connector adapted to terminate a first cable, and further covering a second connector adapted to terminate a second cable, the system comprising: (i) a first elongated body member comprising cable and splice ends, interior and exterior surfaces, and extending along a longitudinal axis, the first elongated body being adapted to envelop at least a portion of the first connector; (ii) a second elongated body adapted to telescopically engage the first elongated body member in enveloping relation to the second connector, the second elongated body member comprising cable and splice ends, interior and exterior surfaces, and adapted to extend co-axially from the first body member when engaged therewith, the second elongated body being adapted to envelop at least a portion of the second connector; and (iii) wherein a portion of the first elongated body is adapted to be positioned between the interior surface of the first elongated body member and the first connector. The second elongated body can further comprise an annular flange that extends about the exterior surface thereof, an upper segment that extends upwardly from the annular flange and a lower segment that extends downwardly from the annular flange. The upper segment of the second elongated body can be formed to be positioned between the interior surface of the first elongated body member and the first connector, and the splice end of the first elongated body member can be formed to abut the annular flange when the first and second elongated bodies are engaged with one another. The first elongated body member can include one or more gripping surfaces on its exterior surface.

An seventh aspect of the present invention provides a system for covering a first connector adapted to terminate a first cable, and further covering a second connector adapted to terminate a second cable. The system of covers essentially comprises a first elongated body member extending along a longitudinal axis and comprising cable and splice ends, interior and exterior surfaces, and adapted to envelop at least a portion of the first connector; a second elongated body adapted to telescopically engage the first elongated body member in enveloping relation to the second connector. The second elongated body member adapted to envelop the second connector comprises cable and splice ends, interior and exterior surfaces, and extends co-axially from the first body member when engaged therewith, and further comprises an annular flange that extends about said exterior surface thereof, an upper segment that extends upwardly from said annular flange and a lower segment that extends downwardly from said annular flange. A portion of the upper segment of the first elongated body is adapted to be positioned between the interior surface of the first elongated body member and the first connector.

A eighth aspect of the present invention provides a cover for a connector adapted to terminate a cable, the cover comprising: (i) a unitary elongated body member having a cable end, a connector end, an interior surface, and an exterior surface; (ii) a plurality of spaced apart grooves formed in a predetermined region of the interior surface of the body member, proximate the cable end; and (ii) wherein the cable end and the connector end are positioned such that the body of the cover forms an angle greater than or less than 180 degrees. The exterior surface of the angled cable cover can further comprise first region extending from the cable end to a first shoulder and including at least one strain relief member defined therein, the first region having a minimum, first cross-sectional diameter, a second region extending from the first shoulder to a second shoulder, the second region having a minimum, second cross-sectional diameter that is less than the minimum, first cross-sectional diameter, and a third region extending from the second shoulder to the connector end, the third region having a minimum, third cross-sectional diameter that is greater than the minimum, second cross-sectional diameter.

A ninth aspect of the present invention provides a customizable port seal comprising: (i) a unitary elongated body having an initial length and comprising a cable end, a connector end, an interior surface, and an exterior surface, and a first section of arbitrary length proximate to the connector end; (ii) wherein the exterior surface of the port seal proximate to the cable end comprises one or more spaced apart grooves; and (iii) wherein at least a portion of the first section is adapted to be removed such that the unitary elongated body has a second, post-removal length which is shorter than the initial length. Optionally, the interior and/or exterior surfaces of each end of the port seal can comprise a plurality of spaced-apart grooves, where each of the grooves extends in spaced parallel relation to the others.

A tenth aspect of the present invention provides a port seal system comprising (i) a customizable port seal which includes a unitary elongated body having an initial length and comprising a cable end, a connector end, an interior surface, and an exterior surface, and a first section of arbitrary length proximate to the connector end, wherein at least a portion of the first section is adapted to be removed such that the unitary elongated body has a second, post-removal length which is shorter than the initial length; and (ii) a cover in overlapping communication with the cable end of the port seal. The cover comprises a unitary elongated body member having a cable end, a connector end, an interior surface, and an exterior surface, and a plurality of spaced apart grooves formed in a predetermined region of the interior surface of the body member, proximate to the cable end. The exterior of the cable cover in the cover system can optionally include a first region extending from the cable end to a first shoulder and including at least one strain relief member defined therein, the first region having a minimum, first cross-sectional diameter, a second region extending from the first shoulder to a second shoulder, the second region having a minimum, second cross-sectional diameter that is less than the minimum, first cross-sectional diameter, and a third region extending from the second shoulder to said connector end, the third region having a minimum, third cross-sectional diameter that is greater than the minimum, second cross-sectional diameter.

BRIEF DESCRIPTION OF THE DRAWINGS

The present invention will be more fully appreciated and understood by reading the following Detailed Description in conjunction with the accompanying drawings, in which.

DETAILED DESCRIPTION

Figure 1:
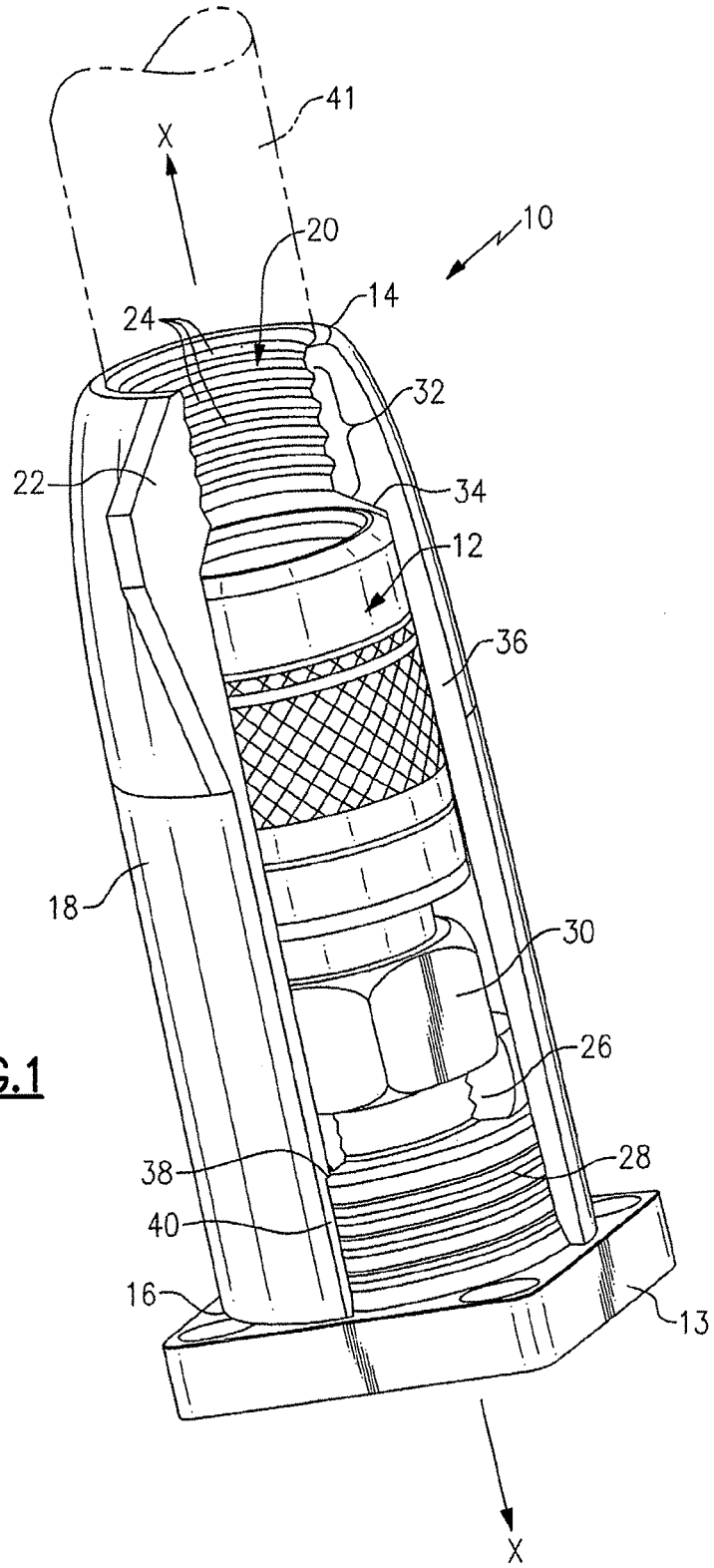
FIG. 1 is a partially cut-away perspective view of a first embodiment of a cover for a first cable connector.
Figure 2:
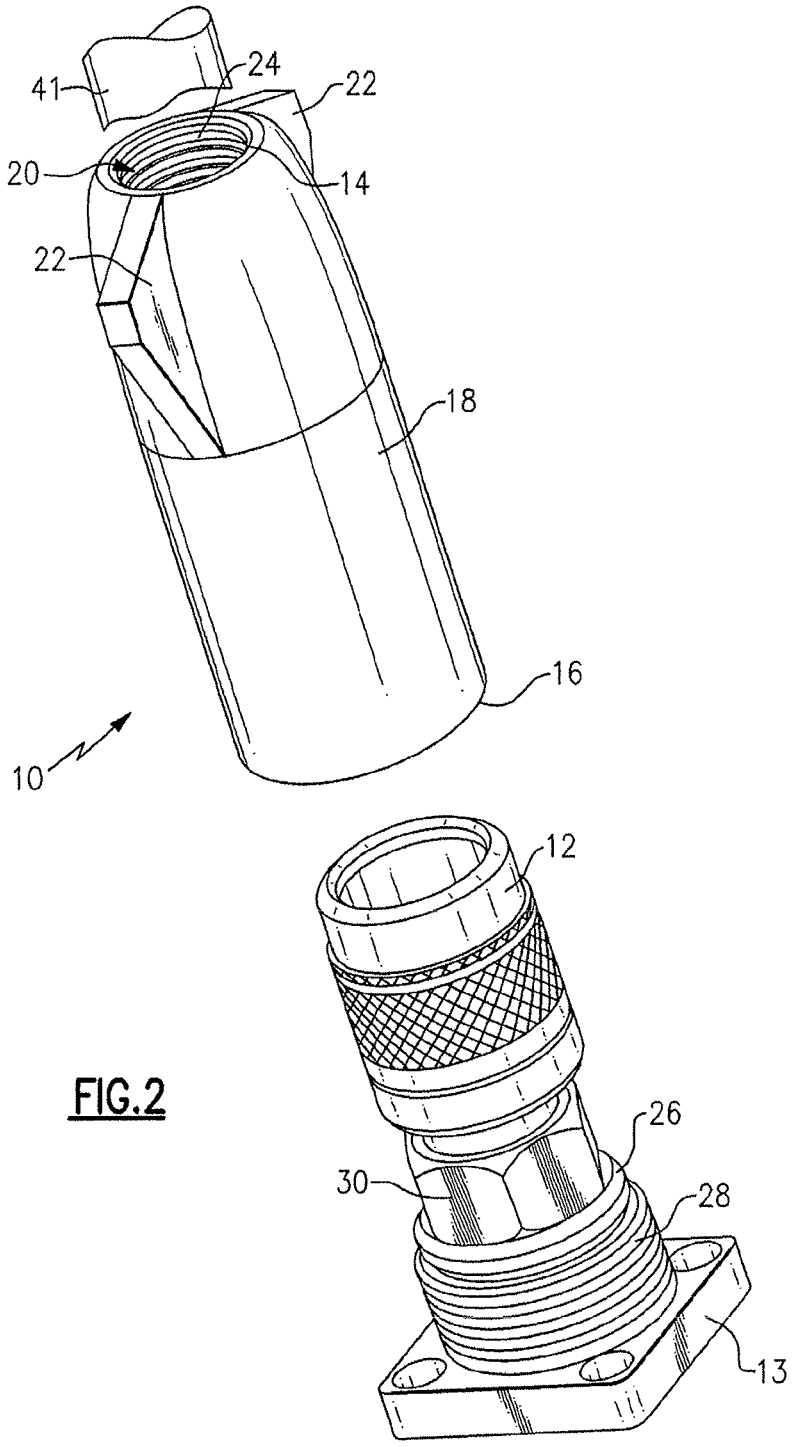
FIG. 2 is a partially exploded perspective view thereof.
Figure 3:
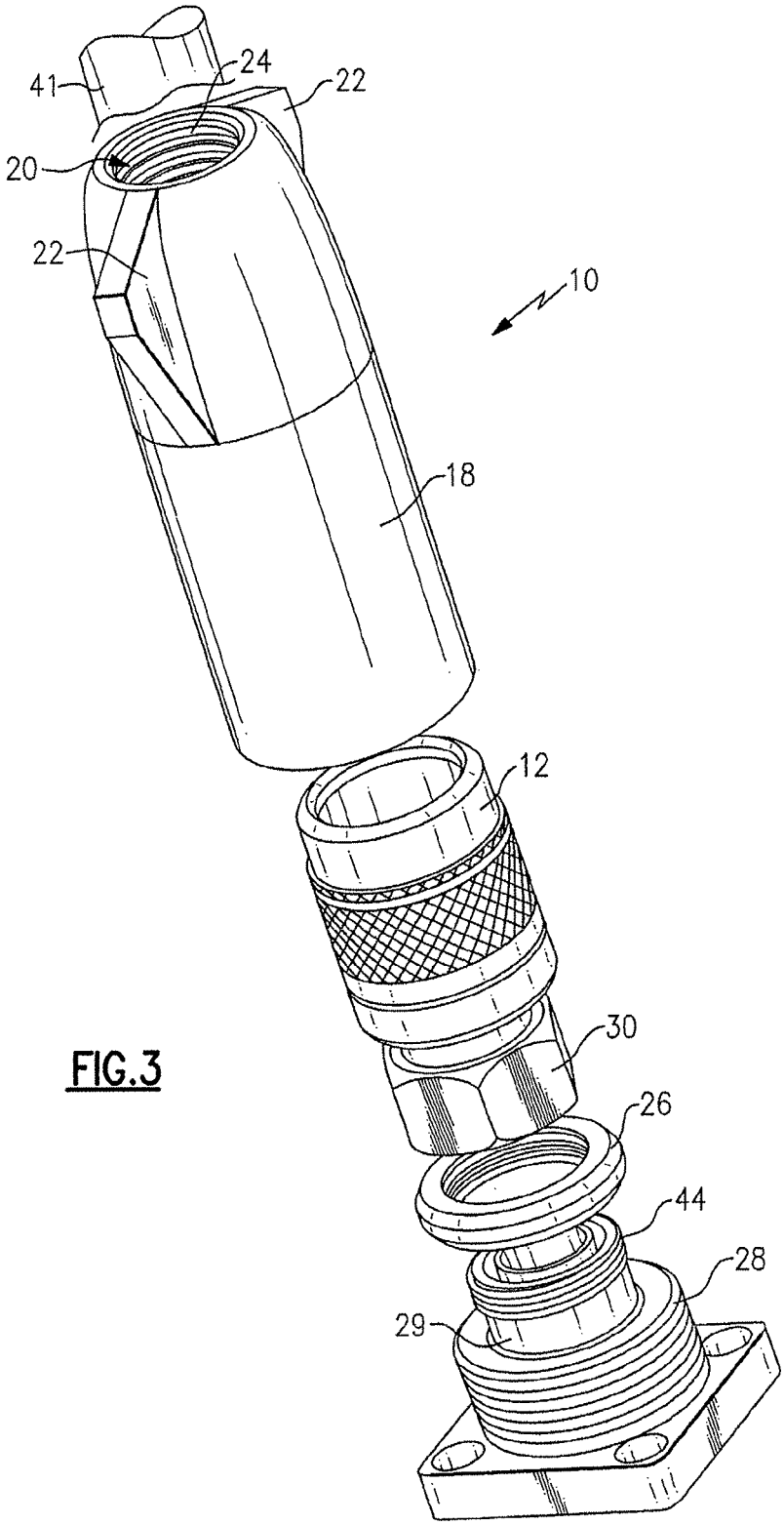
FIG. 3 is a fully exploded perspective view thereof.
Figure 4:
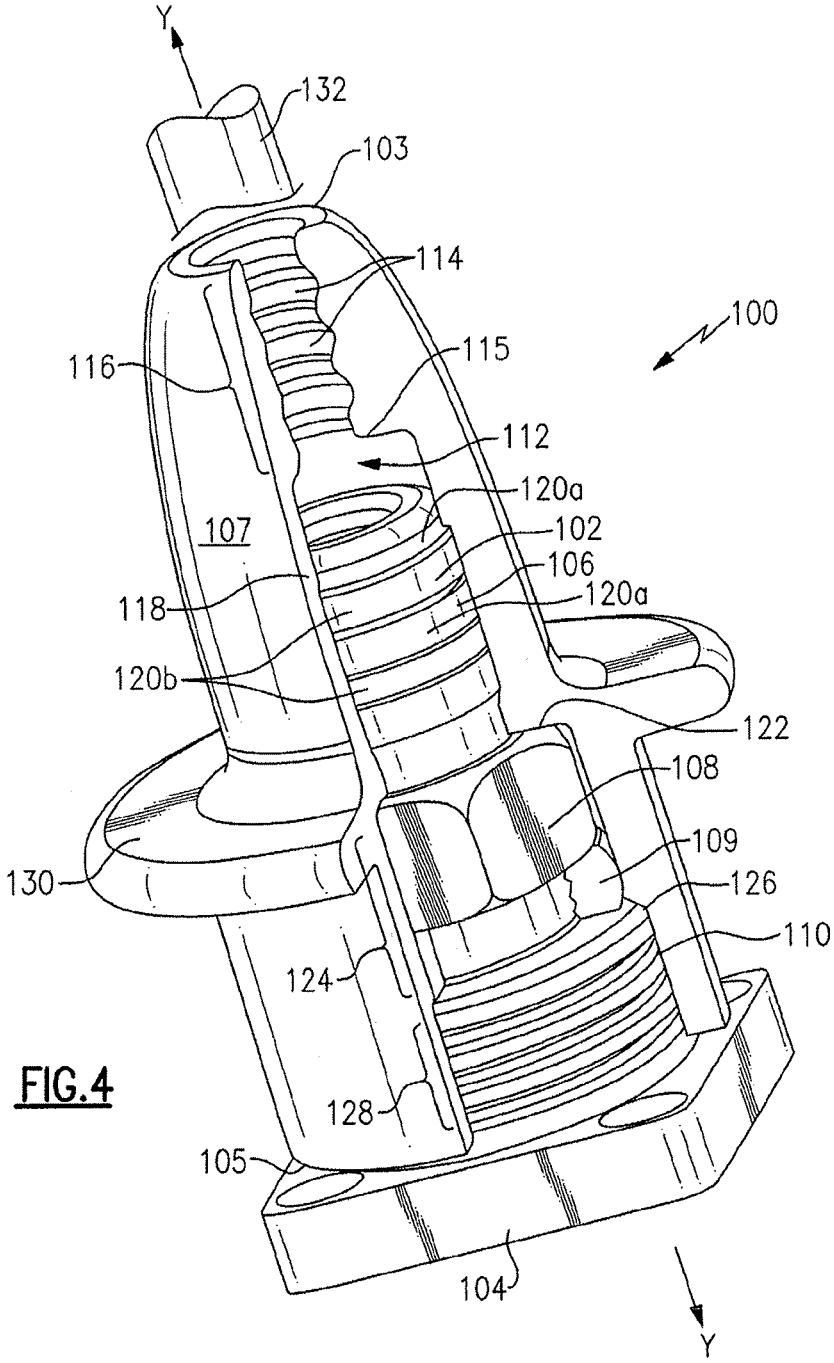
FIG. 4 is a partially cut-away perspective view of a second embodiment of a cover for a second cable connector.
Figure 5:
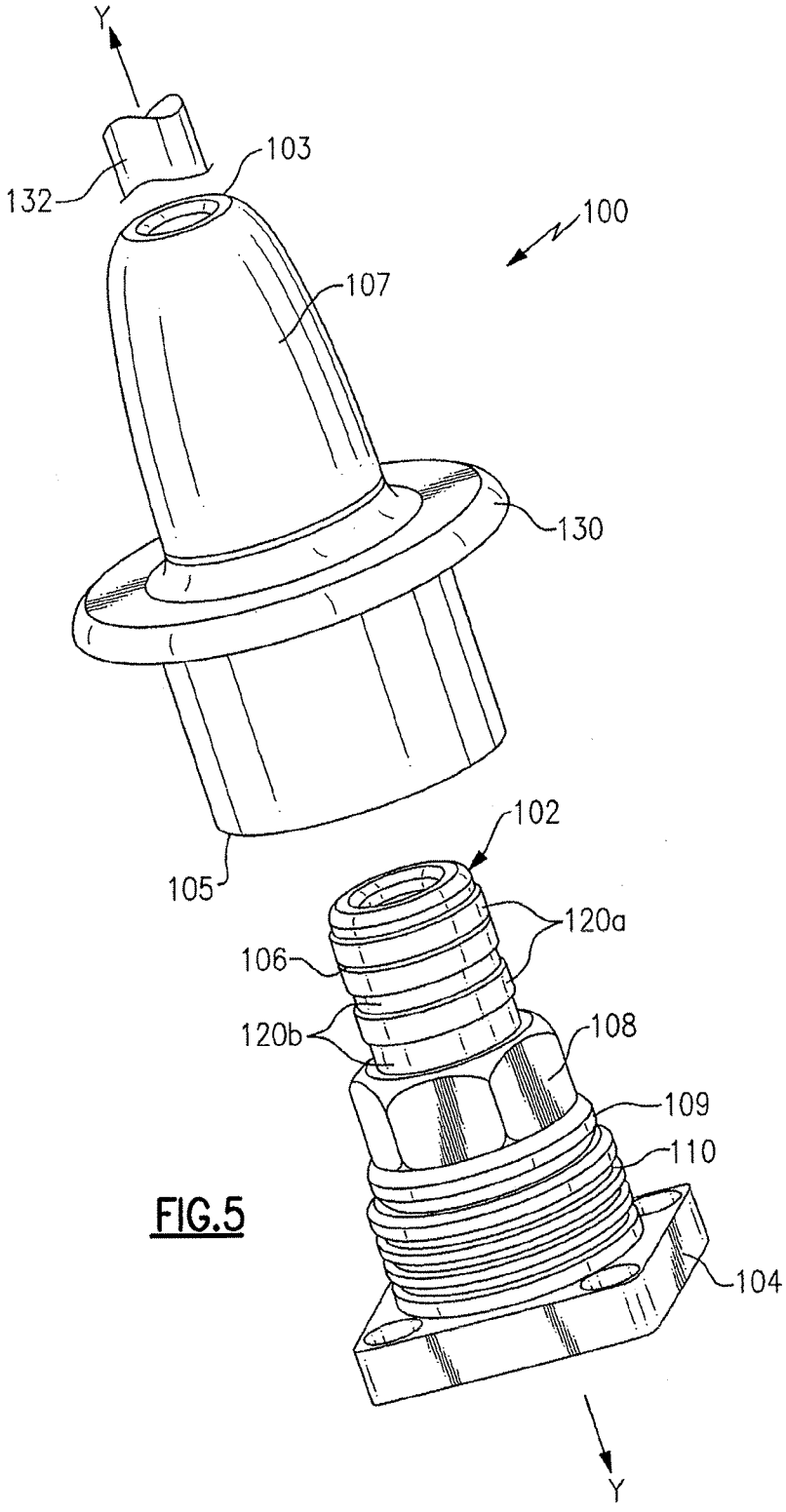
FIGS. 5 and 6 are partially exploded perspective views thereof.
Figure 6:
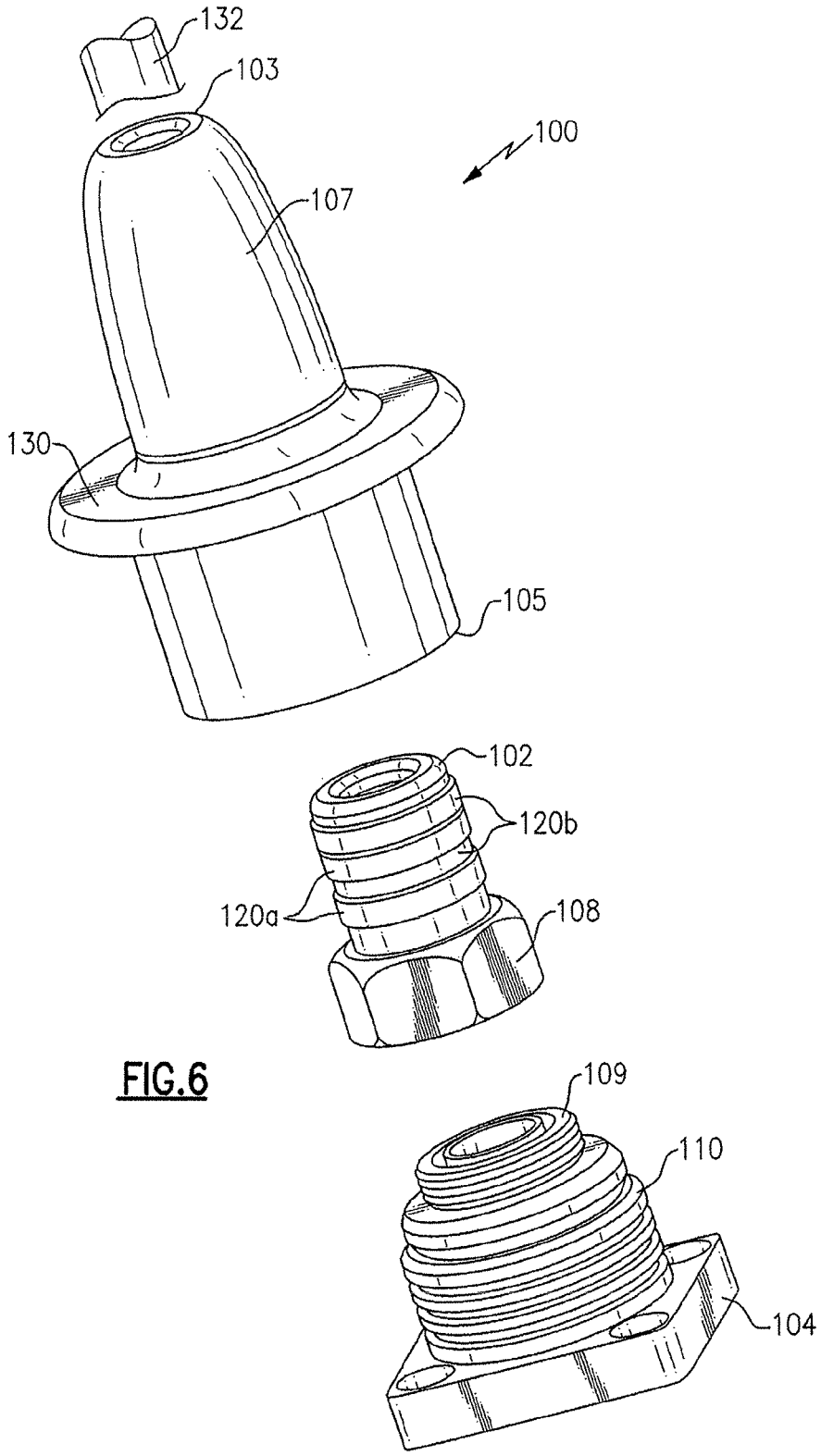
Figure 7:
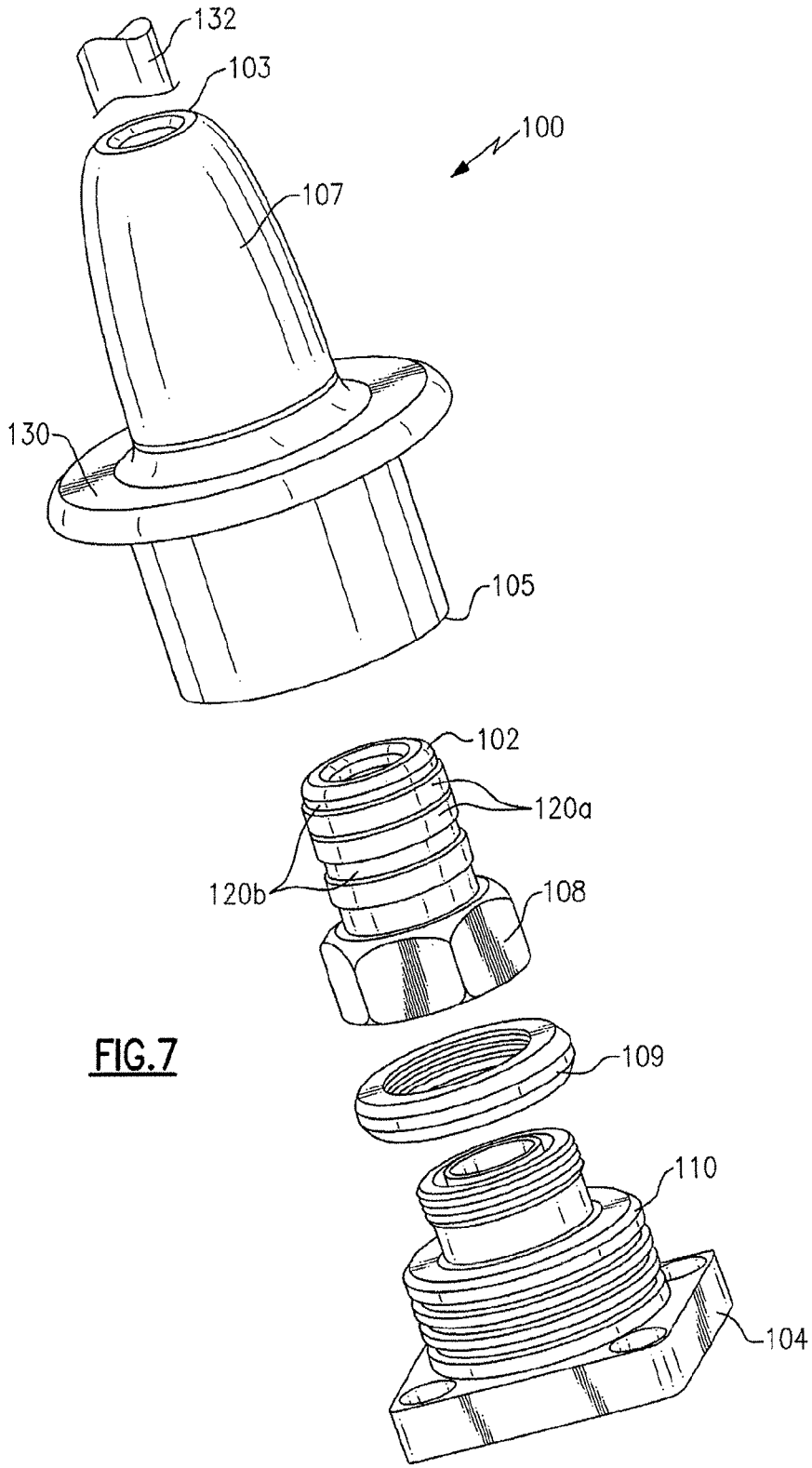
FIG. 7 is a fully exploded perspective view thereof.

Referring now to the drawing figures in which like reference numerals refer to like parts throughout, there is seen in FIG. 1 a cover, designated generally by reference numeral 10, adapted to be placed in secure and sealing relation over a connector 12 (such as a 5-series connector manufactured by John Mezzalingua Associates, Inc. of East Syracuse, N.Y. that is adapted to terminate a ⅞" cable). Connector 12 terminates on a bulkhead 13. In the embodiment of FIG. 1, cover 10 comprises an elongated body composed of a rubber material that exhibits a low modulus of elasticity over an extended temperature range, preferably a silicone rubber, that extends along a longitudinal axis X-X, a cable end 14, bulkhead end 16, exterior surface 18, interior surface 20, and wedge shaped wings 22 extending from opposing sides of exterior surface 18 that provide a gripping surface for a tool or manual engagement, such as pliers or a user's fingers, used to remove cover from covering relation to connector 12. The rubber composition of the cover permit it to elastically deform to the connector and other elements that it covers (e.g., the bulkhead), as will be described in greater detail hereinafter, when being installed or removed.

A series of longitudinally and sequentially spaced grooves 24 are formed in interior surface 20, proximate cable end 14, and extend over a predetermined distance. Notably, grooves 24 are not threads as they are not a continuous helix, but rather spaced apart, parallel grooves that function as small reservoirs for any moisture that may infiltrate the open cable end 14 of cover 10, as will be described in greater detail hereinafter. In the field, scratches or other material removal occurs in the jacket of a cable, and moisture may sometimes infiltrate through those scratches and into the seal. Grooves 24 (and the grooves in the other disclosed embodiments) are intended to minimize the effects of any such moisture migration.

With continued reference to FIG. 1, connector 12 extends outwardly from bulkhead 13 along axis X-X. Bulkhead 13 includes a shank portion 28 that is either integral therewith or comprised of a separate element preferably composed of rubber. If shank portion 28 is integral with bulkhead 13, a rubber gasket 26 is preferably placed in sealing relation at the interface of shank portion 28 and the neck 29 of bulkhead 13. Shank portion 28 is of a diameter having a dimension at least as large as, and preferably larger than the maximum width of coupling element/nut 30 (which is the next widest part of the connector), thus creating the connector's maximum width dimension at the interface of connector 12 and bulkhead 13.

The interior surface 20 of cover 10 includes a first region 32 that is of an essentially constant cross-sectional diameter and extends from cable end 14 to a first shoulder 34 from which it then tapers uniformly (although a stepped shoulder could apply equally) increasing the interior diameter to a second (medial) region 36 of interior surface 20 where it again remains essentially constant for a predetermined length. Second region 36 tapers outwardly (although it could be stepped instead of tapered) at a second shoulder 38 to a third region 40 that extends at a uniform cross-sectional diameter for the remainder of the cover's length until terminating at bulkhead end 16. These distinct regions of respective cross-sectional diameters securely envelop connector 12 and form seals at multiple points along the connector as will be described hereinafter.

To use cover 10, the cover would first be fully slid (cable end 14 first) over a cable 41 that is to be terminated in connector 12, leaving the terminal end of cable 41 exposed. As the cover is designed to have an interference fit with cable 41, it may be useful to apply a small amount of grease to the outside of the cable jacket to assist in pulling the cover over the cable. Cable 41 may then be terminated and attached to connector 12 in a conventional manner. Cover 10 would then be manually slid over connector 12 until its bulkhead end 16 preferably abuts, but at least overlapping with bulkhead 13. When cover 10 is fully positioned over connector 12, first region 32 tightly enwraps cable 41 with shoulder 34 positioned adjacent the terminating end of connector 12, thereby forming a seal between cable 41 and cover 10. If moisture does infiltrate the seal formed between cable 41 and cover 10 (due, for instance, to scratches or other removal of material that often occurs with the cable's jacket), the grooves 24 in first region 32 function as small reservoirs. Medial region 36 extends in tightly covering relation to the majority of connector 12, including its coupling element/nut 42 (although illustrated as a nut, various types of coupling elements are conventionally used on cable connectors of the type herein described) and the interface ring 44 that interfaces connector 12 with bulkhead 13, with a seal being formed at the junction of the interface ring 44 and medial region 36. Shoulder 38 tapers outwardly (Although it could be stepped instead of tapered) to accommodate shank portion 28 with third region 40 adapted to cover the shank portion 28 until the corner terminates in abutting relation to bulkhead 13, with seals being formed between shank portion 28 and cover 10 and between bulkhead 13 and cover 10.

With reference to FIGS. 4-7, an embodiment of a second cover 100 is provided. Cover 100, like cover 10, is adapted for placement in secure and sealed covering relation over a connector 102 (such as a series 4 connector, manufactured and sold by John Mezzalingua, Associates, Inc.) that is for use with a smaller cable (e.g., ½") than is connector 12. However, cover 100, like cover 10, is adapted to envelop a connector that terminates in a bulkhead 104. Connector 102 comprises a connector portion 106, a coupling element/nut 108 (although illustrated as a nut, various types of coupling elements are conventionally used on cable connectors of the type herein described), and interface ring 109 and an enlarged shank portion 110 (that, like shank portion 26, may be integral with or a separate, preferably rubber, element; if integral, a rubber gasket would preferably be placed at the interface of the shank portion and connector), and bulkhead 104.

Connector 100 comprises cable and bulkhead ends 103, 105, respectively, exterior and interior surfaces 107, 112, respectively, and a series of grooves 114 formed in longitudinally spaced relation to one another in interior surface 112 proximate, cable end 106. Grooves 114 serve as reservoirs in the event of moisture migration through cable end 106 to assist in preventing the moisture from leaching into connector 102.

The interior surface 112 of cover 100 includes a first region 116 of an essentially constant diameter that extends from cable end 106 to a first shoulder 115 from which it steps outwardly to an increased cross-sectional diameter that extends essentially uniformly in a second or medial region 118. Notably, the portion of connector 102 that second region 118 is adapted to cover comprises different diameter rings **120*a* and 120*b* with 120*a* being of slightly smaller diameter than 120*b*. The diameter of second region 118 approximates that of rings 120***a* and the pliable nature of cover 100 permits the material to deform to accommodate the relevant portion of connector 102 and consequently securely envelop the larger diameter rings 120*b*, creating tight seals at the transitions between rings 120*a* and 120*b*. Medial region 118 next steps outwardly at a shoulder 122 to a third (also medial) region 124 that is adapted to be positioned in covering relation over nut 108 and interface ring 109. Third region 124 then steps outwardly at shoulder 126 to a fourth region 128 that is adapted to envelop shank portion 110 and terminate at bulkhead 104.

Unlike the wings 22 of cover 10, cover 100 includes a ring 130 that extends around exterior surface 107 in a plane that is essentially transverse to the longitudinal axis Y-Y of cover 100 and is positioned at about the midpoint along the length of cover 100. Ring 130 serves principally as a drip edge to direct any rain water or other moisture away from the interfaces between the cover and the connector/cable. Ring 130 could also serve to provide a gripping surface for a tool used to remove cover 100 from connector 102.

The manner of using cover 100 is the same as that for cover 10; namely sliding cover 100 (cable end first) entirely over a cable 132, and then terminating the cable in connector 102 in a conventional manner. Cover 100 is then slid downwardly in enveloping relation to connector 102 until its distal end 108 preferably abuts, but at least overlaps with bulkhead 104. When cover 100 is fully positioned over connector 102, first region 116 tightly enwraps cable 132 with shoulder 115 positioned adjacent the terminating end of connector 102, thereby forming a seal between cable 132 and cover 100. If moisture does infiltrate the seal formed between cable 132 and cover 100, the grooves 114 function as small reservoirs. Second region 118 extends in tightly covering relation to the majority of connector 102 that extend outwardly from nut 108, with shoulder 120 positioned in sealed relation to nut 108. Third region 124 then extends in sealed relation to nut 108 and interface ring 109, and shoulder 126 tapers (or steps) outwardly such that fourth region 128 can accommodate and extend in sealed relation to shank portion 110 until it terminates in abutting relation to bulkhead 104, with seals being formed between shank portion 110 and cover 100 and between bulkhead 104 and cover 100.

Figure 8:
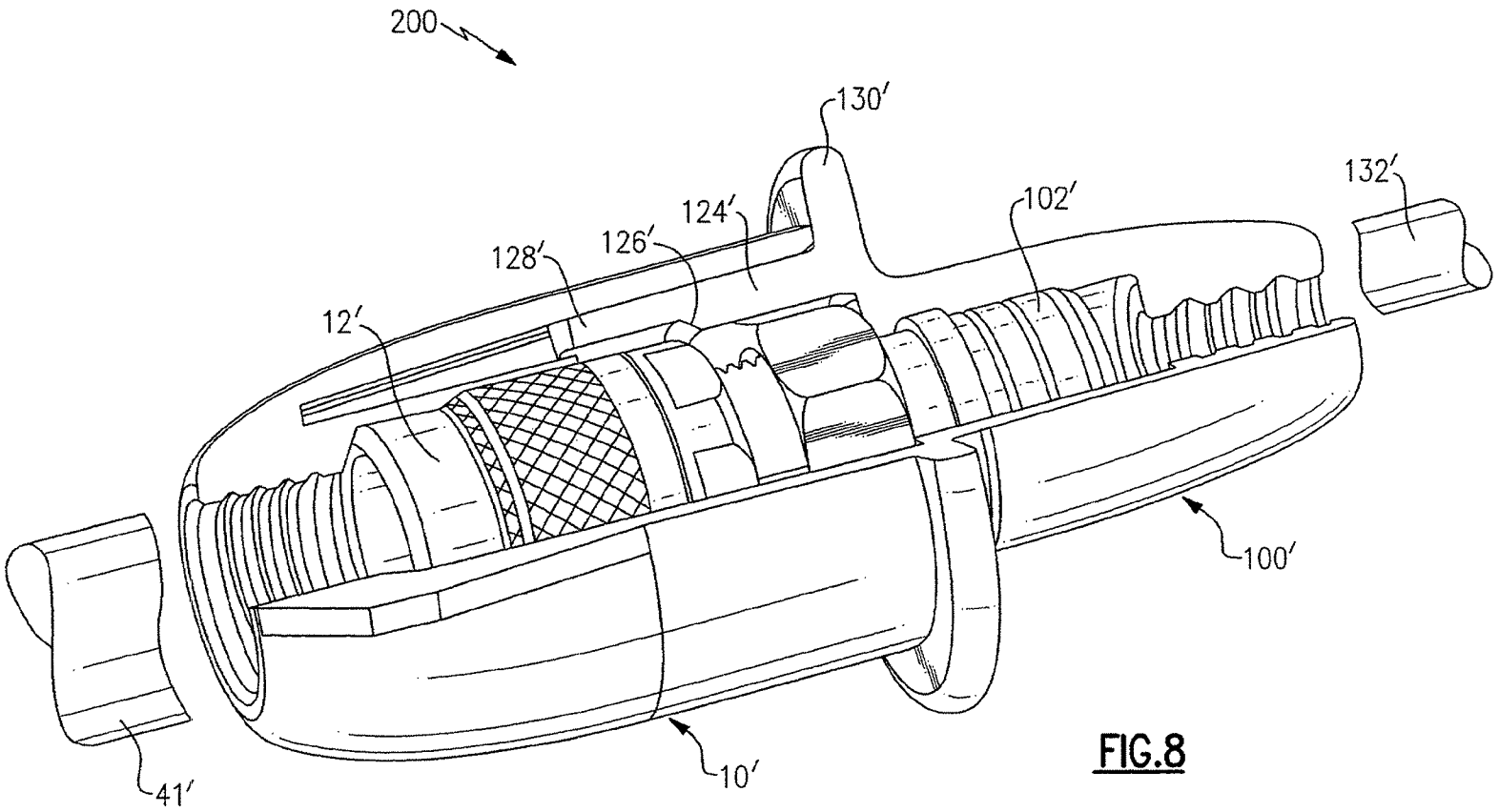
FIG. 8 is a partially cut-away perspective view of a third embodiment of a system of covers for providing cover to first and second cable connectors used to splice two differently sized cables.
Figure 9:
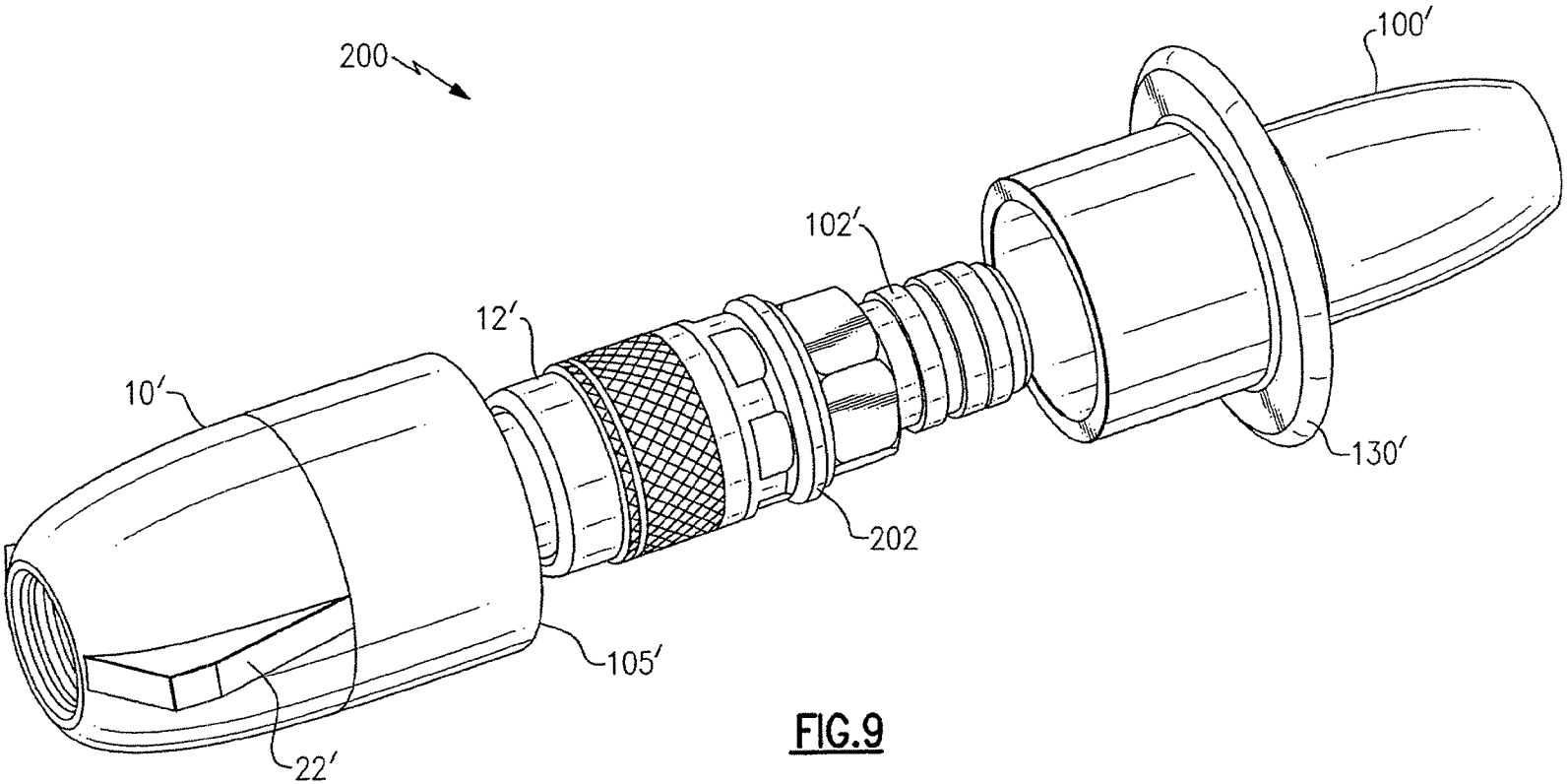
FIG. 9 is a partially exploded perspective view thereof.
Figure 10:
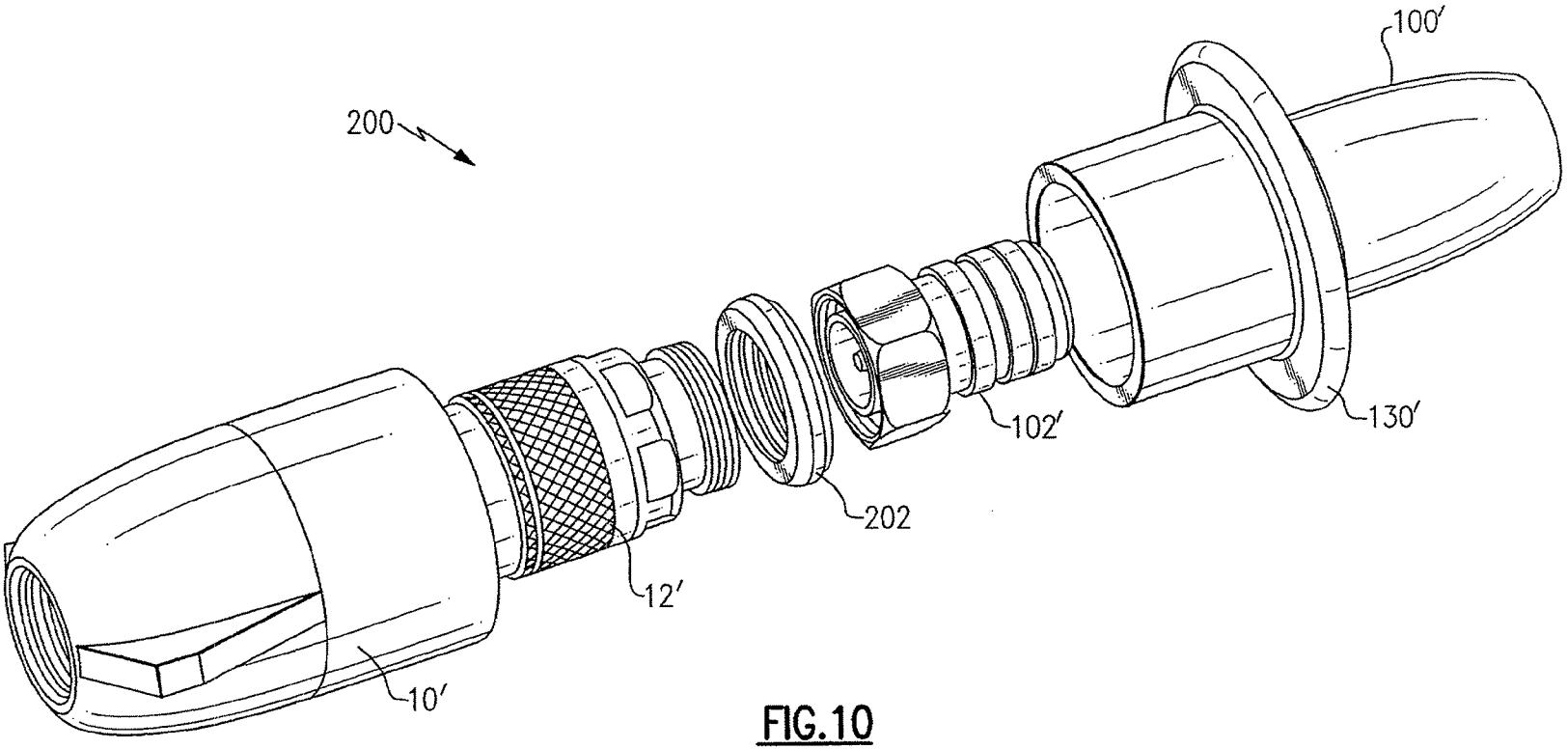
FIG. 10 is a fully exploded perspective view thereof.
Figure 11:
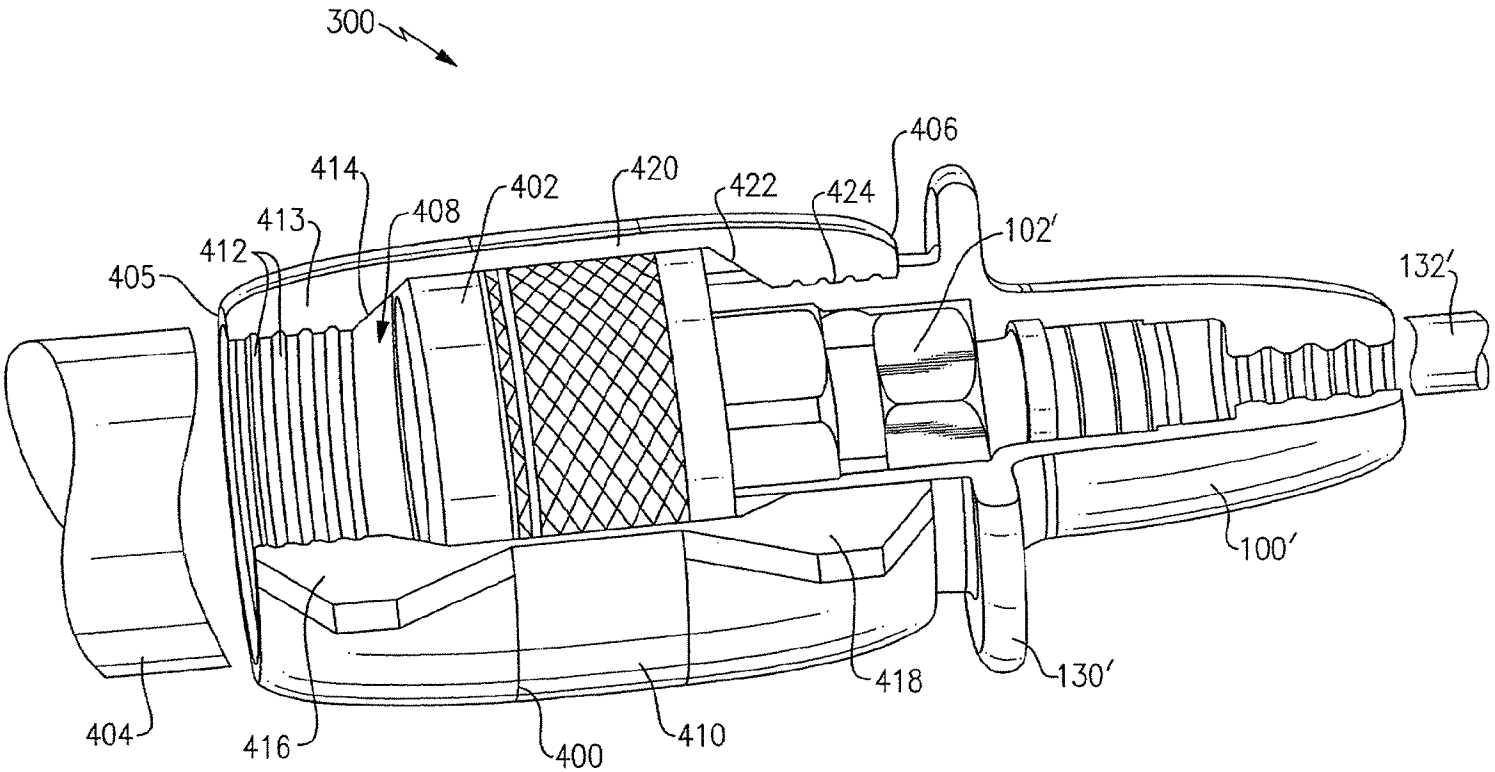
FIG. 11 is a partially cut-away perspective view of a fourth embodiment of a system of covers for providing cover to first and second cable connectors used to splice two differently sized cables.
Figure 12:
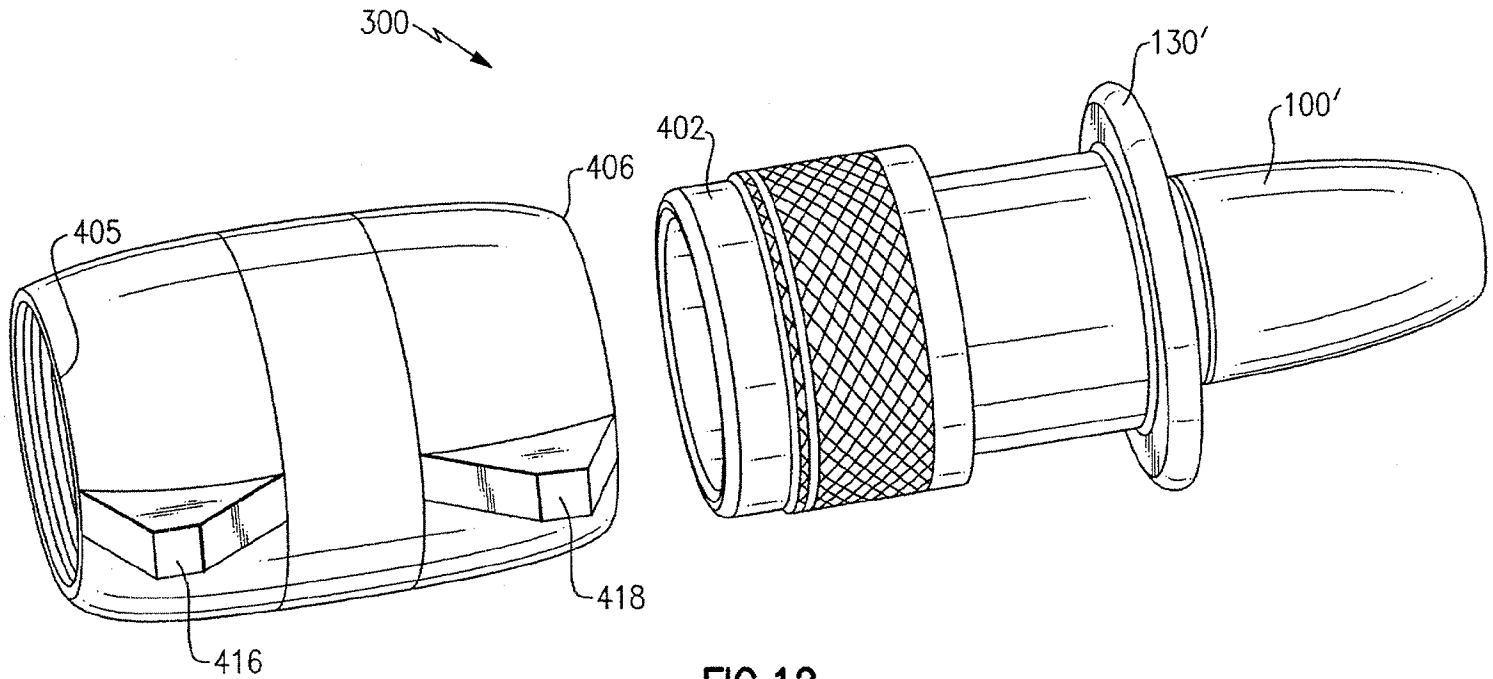
FIGS. 12 and 13 are partially exploded perspective views thereof.
Figure 13:
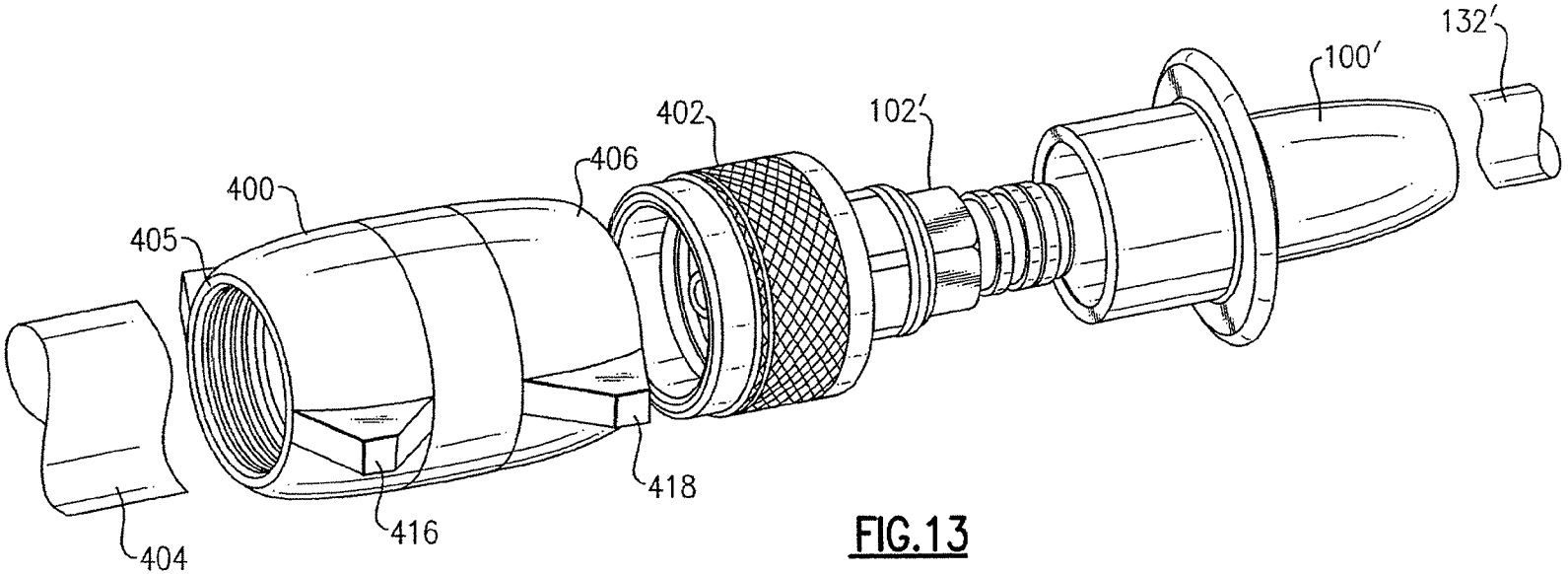
Figure 14:
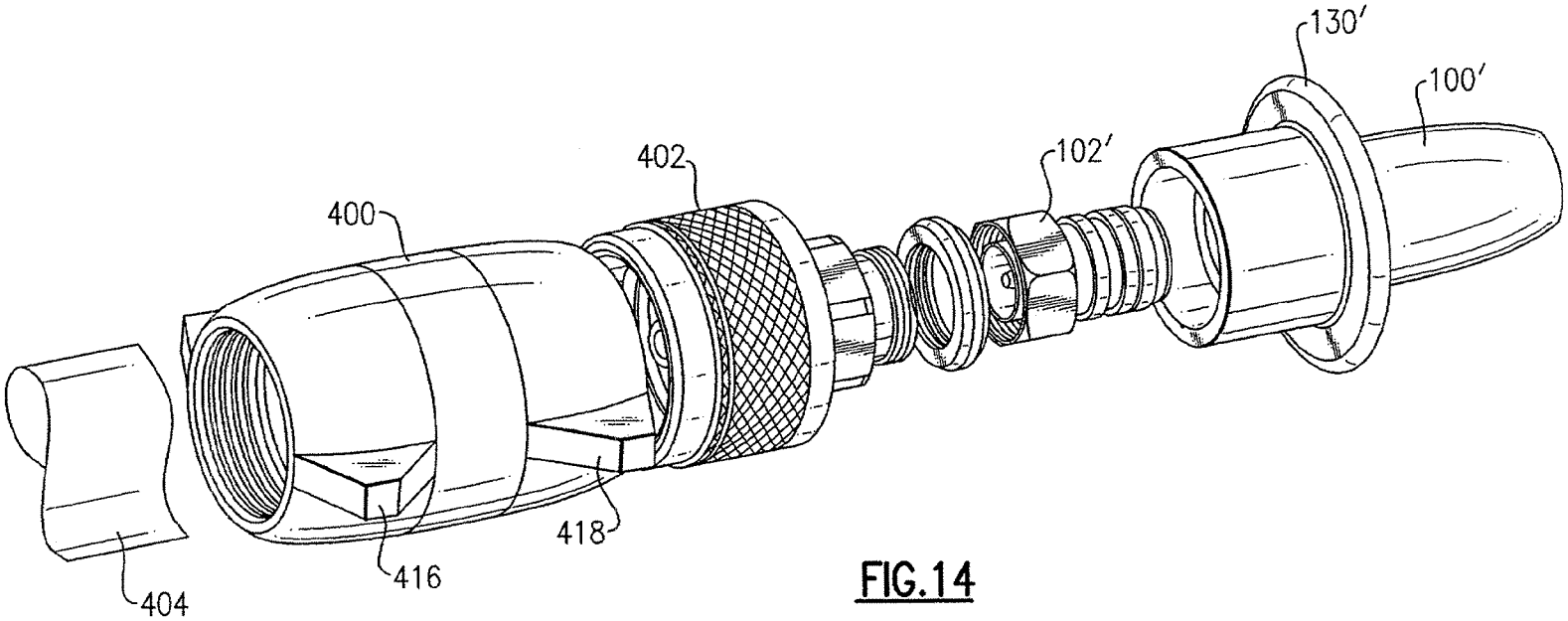
FIG. 14 is a fully exploded perspective view thereof.

While covers 10 and 100 are both adapted to be placed in covering relation to connectors that terminate in a bulkhead, with reference to FIGS. 8 to 14 there is seen a system for covering a pair of connectors that are used to splice together two differently sized cables. FIGS. 8-10 illustrate a system 200 of using covers 10 and 100 (that will be designated 10' and 100' for purposes of differentiating the bulkhead embodiments from the splice embodiment) to splice cables that terminate in connectors 12' and 102' (again, the connectors 12' and 102' are structurally the same as connectors 12 and 102 with the difference being the lack of a bulkhead for terminating the connectors since the connectors are joined together). The structures of covers 10' and 100' are the same as described above for covers 10 and 100, but with a different method of use and resultant arrangement.

System 200 comprises cover 10' adapted to cover connector 12' and cover 100' that is adapted to cover connector 102'. In use, cover 10' is first slide entirely over cable 41' which may then be terminated to connector 12' in a conventional manner, and likewise, cover 100' may be slid over cable 132' which may then be terminated to connector 102'. Next, connectors 12' and 102' are interconnected by applying an appropriate amount of torque to secure the interconnection, with a gasket 202 optionally being positioned between the two to enhance the sealing at the interface of the connectors. Cover 100' may then be slid downwardly into enveloping relation to connector 102'. Finally, cover 10' may be slide over connector 12' with fourth region 128' and at least a portion of third region 124' of cover 100' being telescopically engaged within third region 40'. In addition to the seals created by covers 10' and 100' as previously described, an additional seal is created at the interface of end 105' and cover 100'.

System 300, illustrated in FIGS. 11-14, comprises a cover 400 that is adapted to cover a connector 402 (such as a series 7 connector manufactured by John Mezzalingua Associates, Inc.) in which a cable 404 (e.g., a 1⅝∝ cable) may be terminated, and cover 100' that provides, as previously described, cover for connector 102' that in this embodiment is adapted to be spliced to connector 402. With regard to cover 400, it comprises cable and splice ends 405, 406, respectively, and interior and exterior surfaces 408, 410, respectively. A series of grooves 412 are formed in interior surface 408 in parallel spaced relation to one another in the first region 413 of cover 400 that extends from cable end 408 to a first shoulder 414. Grooves 412, like the other grooves described herein, serve as reservoirs for any moisture that migrate into cover 400 at its interface with cable 404.

While cover 10 includes axial symmetric wings 22, cover 400 includes two sets of axially symmetric positioned wings 416 and 418 that provide gripping surfaces for a tool to assist in pulling cover 400 off connector 402 or pull it into covering relation to connector 402. The extra set of wings is provided due to the larger size cable 404 and connector 402 that cover 400 is adapted to seal as compared to those associated with cover 10, but also permits this cover to be installed in either orientation (as it is symmetrical about its transverse midplane). Interior surface 408 of cover 400 comprises three distinct regions: first region 413, (second) region 420 that extends from shoulder 414 to a second shoulder 422, and a third region 424 that extends between shoulder 422 and splice end 406. Shoulder 414 tapers outwardly from first region 413 to second region 420 which then extends with an essentially constant cross-sectional diameter, and shoulder 422 then tapers back inwardly where third region 424 then continues with an essentially constant cross-sectional diameter. The tapering of shoulders assists in the removal and installation of cover 400 (by providing a draft), but it is conceivable that the shoulders be stepped instead of tapered.

In use, cover 400 is slid fully over cable 404, while cover 100' is slid over cable 132'. Cover 100' may then be slid over connector 102 in the manner previously described, and cover 400 may be slid over connector 402 such that first region 413 envelops cable 404, second region 420 is positioned in covering relation to connector 420 and third region 424 engulfs (or telescopically engages with) the exterior surface of the lower portion of cover 100' with splice end 406 abutting or nearly abutting ring 130'.

Figure 15:
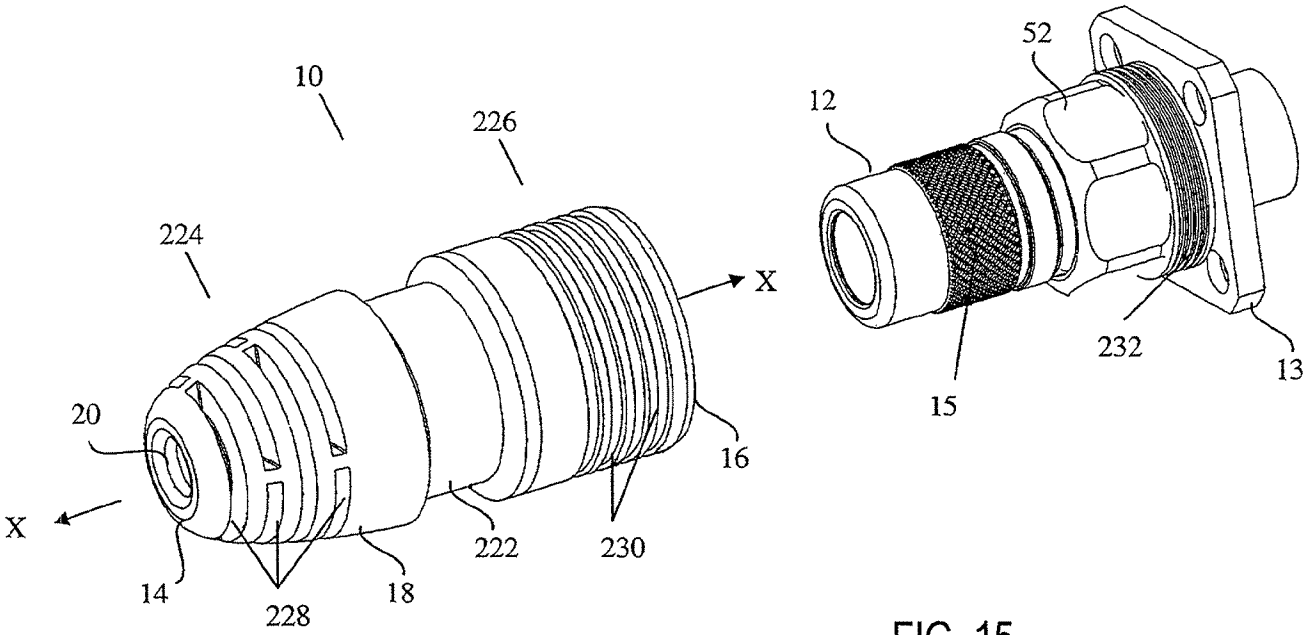
FIG. 15 is an exploded view of a sixth embodiment of a cover and cable connector assembly.

In another embodiment of the cable cover, the cover comprises two or more distinct exterior regions. FIG. 15 depicts a cover 10 adapted to be placed in secure and sealing relation over a connector 12 (such as a 5-series connector manufactured by John Mezzalingua Associates, Inc. of East Syracuse, N.Y. that is adapted to terminate a ⅞" cable). Similar to other embodiments, connector 12 terminates on a bulkhead 13. In the embodiment of FIG. 15, cover 10 comprises: an elongated body composed of a rubber material that exhibits a low modulus of elasticity over an extended temperature range, preferably a silicone rubber, that extends along a longitudinal axis X-X; a cable end 14; bulkhead end 16; exterior surface 18; interior surface 20; and an annular groove 222 of reduced diameter (when compared to the other sections of cover 10 as defined below) formed at a medial position in exterior surface 18. The rubber composition of the cover 10 permits it to elastically deform to the connector and other elements that it covers (e.g., the bulkhead), as will be described in greater detail hereinafter, when being installed or removed. In addition, the reduced diameter of medial section 222 provides a suitable gripping area for a gripping tool or fingers when installing cover 10 on a connector 12.

Cover 10 further comprises a cable end region 224 positioned on the cable receiving side of groove 222, and a bulkhead end region 226 positioned on the bulkhead side of groove 222. The cable end region 224 includes a plurality of strain relief grooves 228 formed therein with each groove 228 extending less than entirely around the circumference of exterior surface 18, although it should be noted that a single strain relief may be suitable in a particular application and the groove could extend entirely around the circumference. In one embodiment, two of the grooves are disconnected from one another by a gap between their ends, and are formed around the circumference of exterior surface in a common plane that extends transverse to the longitudinal axis X-X. In one embodiment, cable end region 224 is provided with a plurality of strain relief grooves 228 formed in co-planar pairs around exterior surface 18 and with each pairing extending in laterally spaced, parallel planes to one another.

Grooves 228 serve several purposes. Due to the interference type fit of cover 10 over connector 12, the material removal required to form grooves 228 facilitates easier stretching of the cover over the connector due to less surface contact, and hence friction, during the covering process. Grooves 228 further permit cover 10 to bend in the areas of grooves 228, thereby providing strain relief when the cable (not shown) is bent.

Bulkhead end region 226 comprises a series of grooves 230 formed entirely circumferentially around exterior surface 18 in spaced, parallel relation to one another. In this embodiment of the present invention, grooves 230 provide reservoirs in which liquid may collect. In one embodiment, grooves 230 provide pressure points to engage or otherwise frictionally interact with grooves on the inner surface of another cover, as will be described in greater detail hereinafter.

As shown in FIG. 15, connector 12 extends outwardly from bulkhead 13 along axis X-X. Bulkhead 13 includes a shank portion 232 that is either integral therewith or comprised of a separate element preferably composed of rubber. If shank portion 232 is integral with bulkhead 13, a rubber gasket (not shown) is preferably placed in sealing relation at the interface of shank portion 232 and the neck of bulkhead 13. Shank portion 232 is of a diameter having a dimension at least as large as, and preferably larger than the maximum width of coupling element/nut 52 (which is the next widest part of the connector), thus creating the connector's maximum width dimension at the interface of connector 12 and bulkhead 13.

Figure 16:
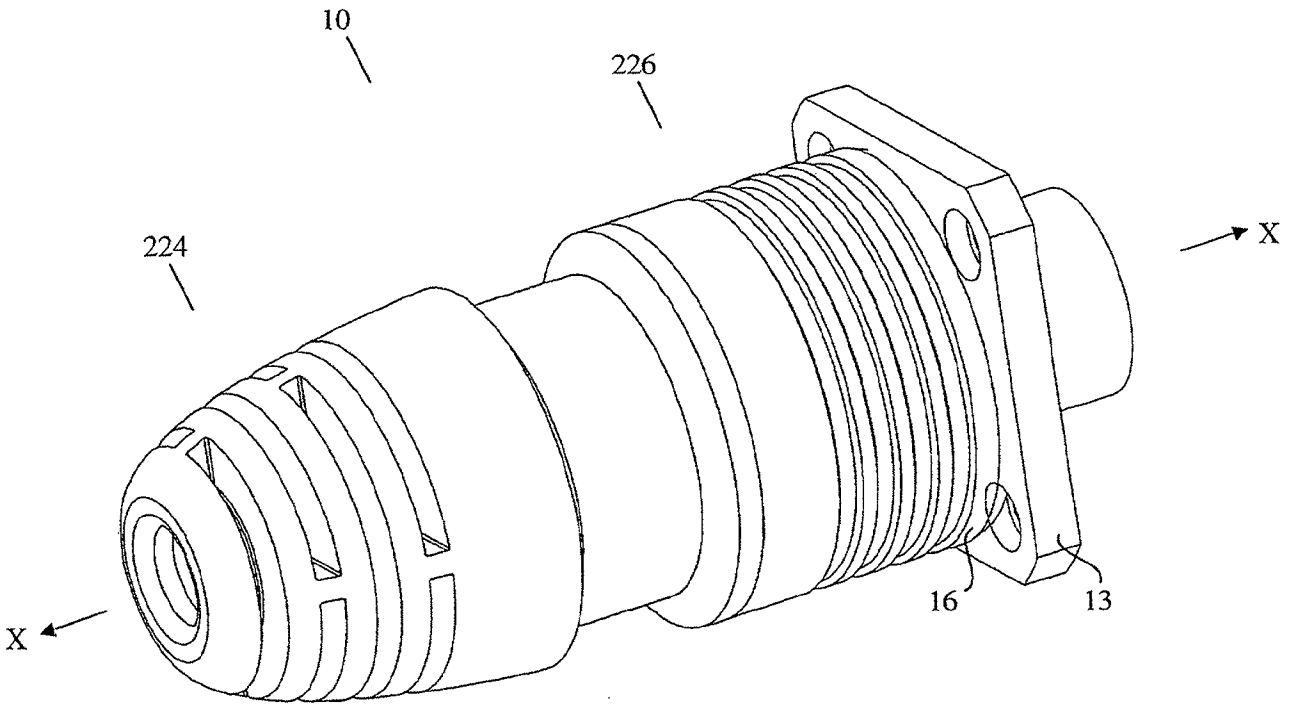
FIG. 16 is a side view of an assembled configuration thereof.

FIG. 16 depicts cover 10 fully assembled onto connector 12. In the assembled configuration, bulkhead end 16 of cover 10 is in reversible communication with bulkhead 13 to provide environmental protection.

Cover 10 (and all embodiments of the cover) is preferably pre-lubricated with a dry lubricant on its inside surface to ease the installation. Impregnating the rubber material composing the covers at the time of manufacture with an oil/grease composition is also effective in reducing the force required to install a cover over a connector.

Figure 17:
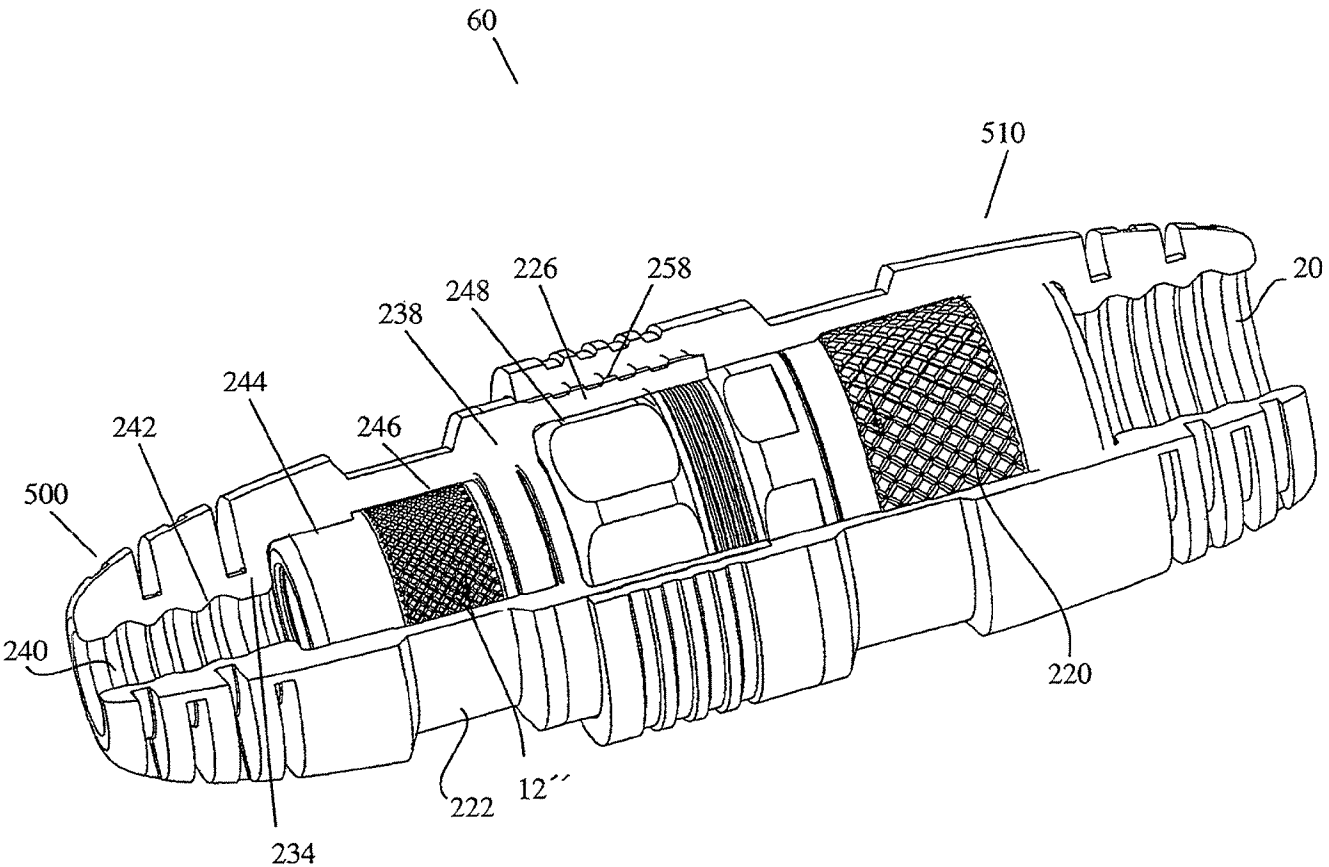
FIGS. 17-19 are partially cut-away perspective views of a seventh embodiment of a system of covers for providing cover to first and second cable connectors used to splice two differently sized cables.

Referring now to FIG. 17, the interior surface 240 of cover 10 includes a first region 242 that is of a serrated cross-section (and thus of continuously fluctuating diameter) and extends from cable end 14 to a first shoulder 234 from which it steps outwardly to a second region 244 of increased, essentially constant cross-sectional diameter. From this second region 244, the interior transitions outwardly via a step to the medial region's 222 interior diameter 246 where it remains essentially constant until shoulder 238 and then steps outwardly once more to a final internal region 248 that corresponds with bulkhead region 226. Region 248 is of an essentially constant cross-sectional diameter. These distinct regions of respective cross-sectional diameters securely envelop connector 12 and form seals at multiple points along the connector as will be described hereinafter.

In another embodiment of the invention, the interior surface 240 of cover 10 includes a first region 242 that extends from cable end 14, as shown in FIG. 15, to a first interior shoulder 234. This first region has a first cross-section diameter. At shoulder 234, interior surface 240 steps outwardly to a second region 44 having a second, essentially constant cross-sectional diameter. In this embodiment, the second cross-sectional diameter is larger than the first cross-sectional diameter. Looking at FIG. 15, the first interior region 242 with the first cross-sectional diameter would fit over region 15 of connector 12, and the second interior region 244 with the second cross-sectional diameter would fit over the coupling element/nut 52. These distinct regions of respective cross-sectional diameters securely envelop connector 12 and form seals at multiple points along the connector.

To use cover 10, the cover would first be fully slid (cable end 14 first) over a cable (not shown) that is to be terminated in connector 12, leaving the terminal end of the cable exposed. As the cover 10 is designed to have an interference fit with the cable, it may be useful to apply a small amount of grease to the outside of the cable jacket to assist in pulling the cover over the cable (although the preferred pre-lubricated rubber composition of cover may make such step unnecessary). The cable may then be terminated and attached to connector 12 in a conventional manner. Cover 10 would then be manually slid over connector 12 until its bulkhead end 16 preferably abuts, but at least overlaps with bulkhead 13. When cover 10 is fully positioned over connector 12, first region 224 of cover 10 tightly enwraps the cable with shoulder 234 positioned adjacent the terminating end of connector 12, thereby forming a seal between the cable and cover 10. If moisture does infiltrate the seal formed between the cable and cover 10 (due, for instance, to scratches or other removal of material that often occurs with the cable's jacket), the grooves in first region 224 function as small reservoirs. Medial region 222 extends in tightly covering relation to the majority of connector 12, including its coupling element/nut 52 (although illustrated as a nut, various types of coupling elements are conventionally used on cable connectors of the type herein described) and the interface ring 244 that interfaces connector 12 with bulkhead 13, with a seal being formed at the junction of the interface ring 244 and medial region's 222 interior diameter 246. Shoulder 238 of cover 10 tapers outwardly (although it could be stepped instead of tapered) to accommodate shank portion 232, with internal region 248 adapted to cover the shank portion 232, with seals being formed between shank portion 228 and cover 10.

Figure 18:
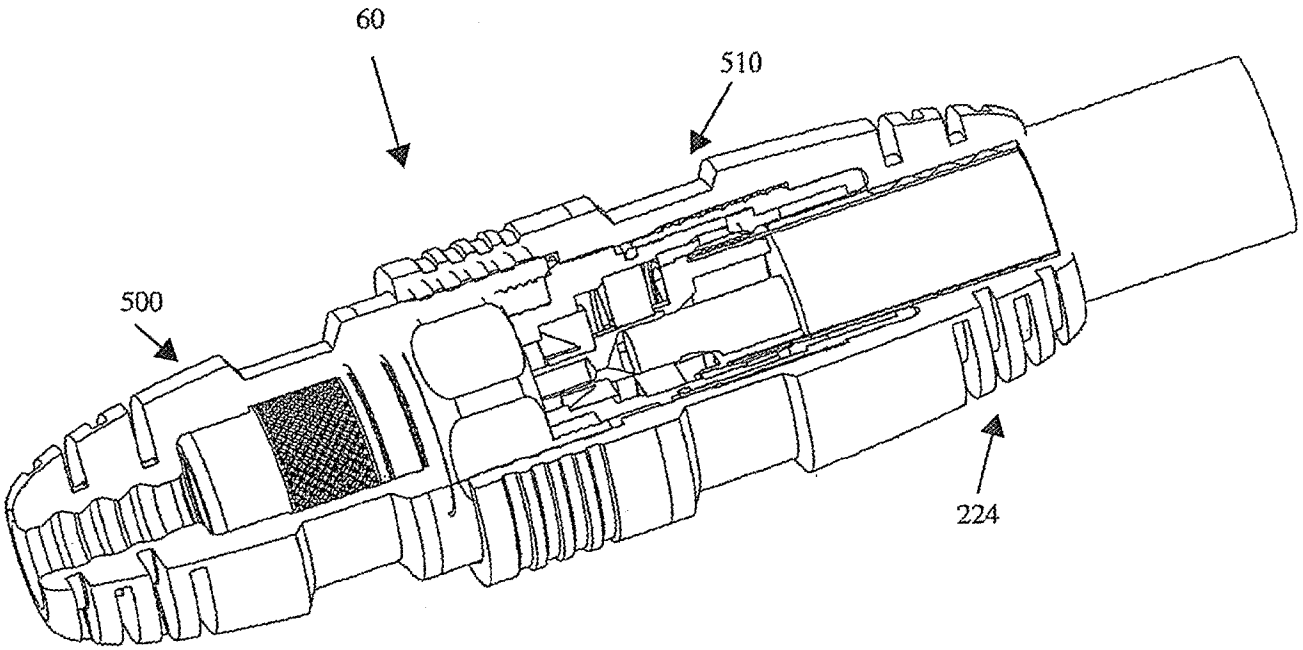
Figure 19:
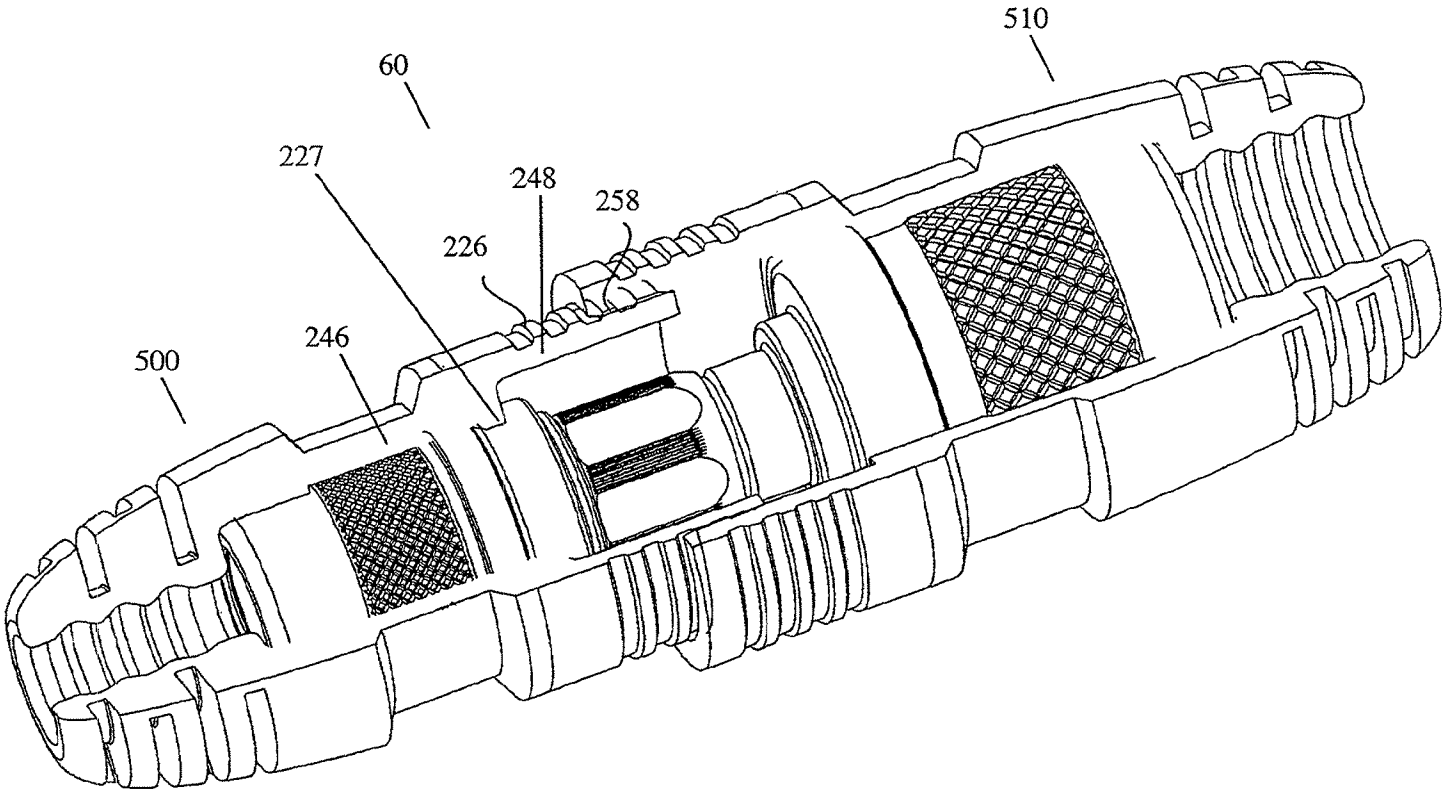

While cover 10 is adapted to be placed in covering relation to connectors that terminate in a bulkhead, with reference to FIGS. 17-19 there is seen a system for covering a pair of connectors that are used to splice together two differently sized cables. FIGS. 17-19 illustrate a system 60 of using covers 10 (which will be designated 500 for purposes of differentiating the bulkhead embodiments from the splice embodiment) and 510 to splice cables that terminate in connectors 12" and 220. The structures of covers 500 and 510 can be the same as described above for cover 10, but with a different method of use and resultant arrangement.

FIG. 17 depicts covers 500 and 510 in a fully assembled configuration in system 60. In this configuration, the smaller cover 500 protects a smaller connector 12" (such as 4-series connector manufactured by John Mezzalingua Associates, Inc. of East Syracuse, N.Y. that is adapted to terminate a ½" cable) while the larger cover 510 protects a larger connector 220 (such as 5-series connector manufactured by John Mezzalingua Associates, Inc. of East Syracuse, N.Y. that is adapted to terminate a ⅞" cable). To position covers 500 and 510 into the assembled configuration, cover 500 is first slid over connector 12 as described above. Cover 510 is then slid over connector 220. To form a protective seal the internal region 258 of second cover 510, which is optionally of a serrated cross-section (and thus of continuously fluctuating diameter) as shown in FIG. 18, is slid over external region 226 of cover 500. In addition to forming a protective seal, the interference fit between region 258 of second cover 510 and grooves of region 226 in cover 500 inhibits removal of either cover without the application of force specifically directed toward disassembling the assembly.

Covers 10, 10', 100', 400, 500, or 510 can be adapted to various configurations in order to protect the cable connector. Typically, the configuration of the cover will depend on the shape, size, or other physical characteristics of the connector. For example, in FIG. 17 internal surface 20 of second cover 510 is wider than internal surface 20 of cover 500 in order to encompass a larger connector or cable. In yet another embodiment shown in FIG. 18, region 224 of cover 510 is elongated to cover an elongated connector. In other embodiments, the cover can be as elongated as is necessary to protect the connector. FIG. 19 shows an assembled configuration in which internal region 258 of second cover 510 does not completely cover external region 226 of cover 500 due to the physical characteristics of the depicted cable connectors. The thickness of material between the external surface of the cover and the internal surfaces such as 242, 246, and 248 can also independently vary between very thin and very thick depending upon design requirements or the needs of the user.

FIG. 19 also depicts another important aspect of the present invention. As the interior of cover 500 transitions from region 246 to region 248, the cover can optionally include an annular ridge 227 that is of a similar or smaller diameter than internal region 246. During assembly, ridge 227 essentially snaps over the connector, creating yet another tight seal to further protect the cable connectors from prevent moisture and other environmental factors while inhibiting the removal of the cover without the application of force specifically directed toward disassembling the assembly.

Figure 20:
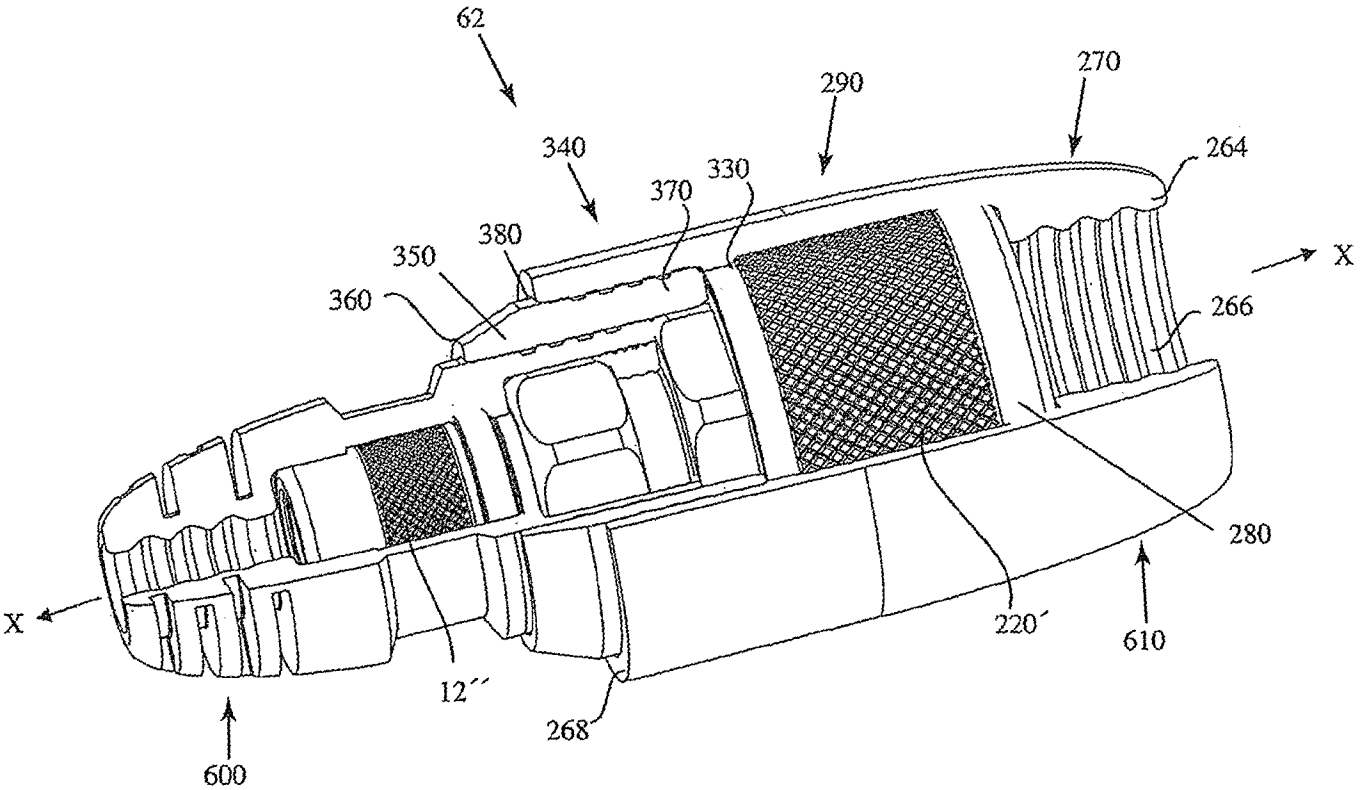
FIG. 20 is a partially cut-away perspective view of a eighth embodiment of a system of covers for providing cover to first and second cable connectors and using an adaptor.

FIG. 20 depicts another embodiment of the system for covering a pair of connectors that are used to splice together two differently sized cables. In this system 62, covers 10 and 100 (which are designated 600 and 610, respectively for purposes of differentiating the bulkhead embodiments from both the splice embodiment and previous system 60) splice cables that terminate in connectors 12" and 220' (connectors 12" and 120' can be structurally the same as or similar to connectors 12, 12', and 220 with the difference being the lack of a bulkhead for terminating the connectors since the connectors are joined together). The structures of cover 600 is the same as described above for other covers, but with a different method of use and resultant arrangement.

In contrast, the structure of cover 610 is different from the structure of the previous covers. Cover 610 is adapted to be placed in secure and sealing relation over a connector (such as a 6-series connector manufactured by John Mezzalingua Associates, Inc. of East Syracuse, N.Y. that is adapted to terminate a 1 & ¼" cable) or another cover. In the embodiment of FIG. 20, cover 610 comprises: an elongated body composed of a rubber material that exhibits a low modulus of elasticity over an extended temperature range, preferably a silicone rubber, that extends along a longitudinal axis X-X; a cable end 264; interior surface 266; and a cable connector end 268. The interior surface 266 of cable end 264 of cover 610 includes a first region 270 that is a serrated cross-section (and thus of continuously fluctuating diameter) and extends from cable end 264 to a first shoulder 280 from which the interior surface steps outwardly to a second region 290 of increased, essentially constant cross-sectional diameter. From this second region 290, the interior transitions inwardly to shoulder 330, thence outwardly to a final region 340. The interior surface of region 340 is of an essentially constant cross-sectional diameter. These distinct regions of respective cross-sectional diameters securely envelop both connector 220' and cover 600 to form seals at multiple points as will be described hereinafter.

FIG. 20 depicts covers 600 and 610 in a fully assembled configuration in system 62. In this configuration, the smaller cover 600 protects a smaller connector 12" (such as 4-series connector manufactured by John Mezzalingua Associates, Inc. of East Syracuse, N.Y. that is adapted to terminate a ½" cable) while the larger cover 610 protects a larger connector 220' (such as 6-series connector manufactured by John Mezzalingua Associates, Inc. of East Syracuse, N.Y. that is adapted to terminate a 1 & ¼" cable). To position covers 600 and 610 into the assembled configuration, cover 600 is first slid over connector 12" as described above. Cover 610 is then slid over connector 220'. To form a protective seal region 340 of second cover 610 is slid over the connector region of cover 600. In addition to forming a protective seal, the interference fit between the interior surface of cover 610 and the grooves of the connector region of cover 600 inhibits removal of either cover without the application of force specifically directed toward disassembling the assembly. Furthermore, having the plurality of grooves provides redundancy in terms of inhibiting moisture migration; if one of the peaks forming grooves is sliced or otherwise compromised, moisture may infiltrate and reside in the valley of that groove (i.e, each valley provides a successive reservoir for moisture containment).

Figure 21A:
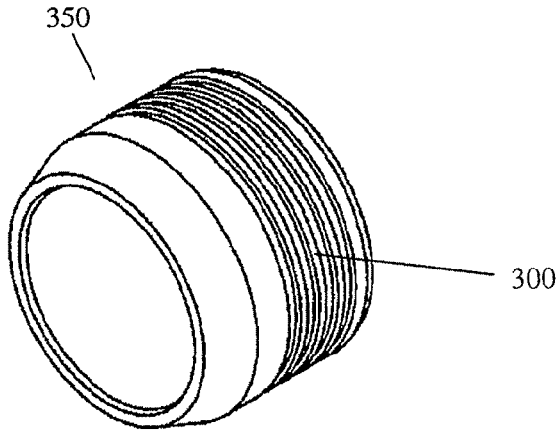
FIG. 21A is a side view of a first embodiment of an adaptor.
Figure 21B:
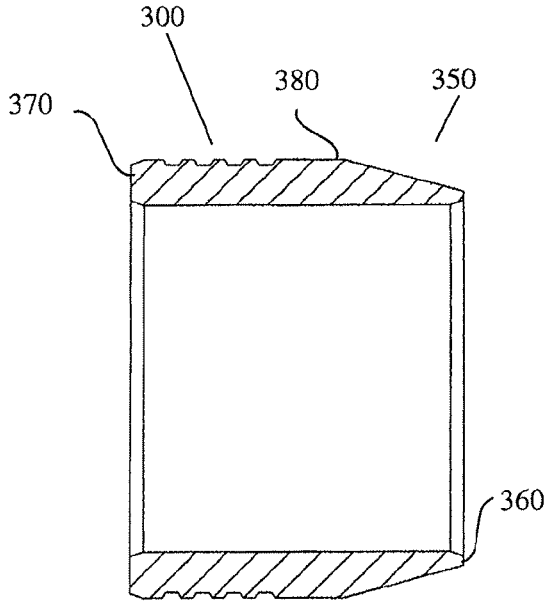
FIG. 21B is a bisecting cut-away view of one embodiment of the adaptor.

FIG. 20 also depicts an adaptor 350 used in conjunction with the cable covers to further protect the cable connectors from prevent moisture and other environmental factors. Specifically, adaptor 350 is used to fill the space left by two covers of non-interfering dimensions. For example, in FIG. 20, the interior diameter of the connector end of cover 610 is greater than the outer diameter of the connector end of cover 600, thereby creating a gap that would allow moisture to directly access the cable connectors. Adaptor 350 is used to fill that gap. As shown more clearly in FIGS. 21A and 21B, adaptor 350 comprises: an elongated body composed of a hard plastic material (e.g., glass filled nylon), although other materials, including metal, could be used, that has a higher modulus of elasticity than the elastomeric rubber material of the covers and that extends along a longitudinal axis X-X; a first end 370; and a second end 360. The exterior surface of the adaptor defines a region 300 which extends from first end 370 to a first shoulder 380. Region 300 is of serrated cross-section (and thus of continuously fluctuating diameter). In one embodiment of the adaptor, the diameter of the exterior surface gradually decreases from a maximum diameter at shoulder 380 to a minimum diameter at second end 360, although many other designs are possible.

To position the covers and adaptor 350 into the assembled configuration shown in FIG. 20, cover 600 is first slid over connector 12" as described above. The adaptor is then fully slid over cover 600, with second end 360 of the adaptor sliding over the connector end of cover 600 (although the adaptor could alternatively be slid onto the cable end of cover 600, with first end 370 of the adaptor sliding onto the cover first). In this configuration, the interference fit between the interior surface of adaptor 350 and the grooves of the connector region of cover 600 inhibits removal of the adaptor without the application of force specifically directed toward disassembling the assembly (the differing material compositions of adapter 350 and any of the covers does facilitate movement with slightly less force than would be required if the adapter was also composed of the same elastomeric material as the covers). Cover 610 is then slid over connector 220'. To form a protective seal, region 340 of second cover 610 is slid over the region 300 of adaptor 350. In addition to forming a protective seal, the interference fit between the interior surface of cover 610 and the serrated exterior surface of region 300 of the adaptor inhibits removal of either cover without the application of force specifically directed toward disassembling the assembly.

Figure 21C:
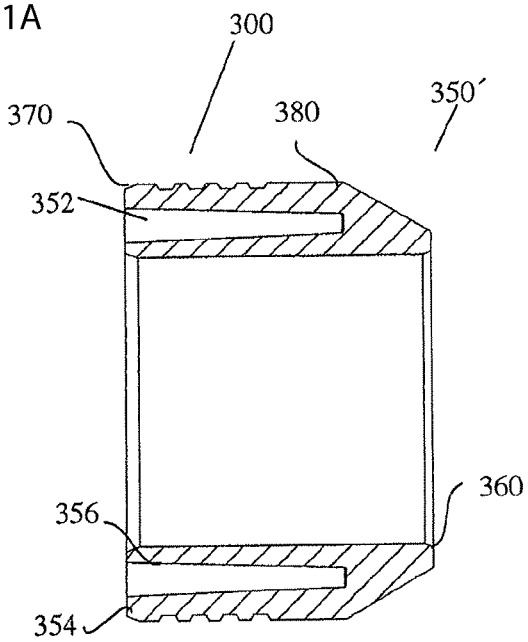
FIG. 21C is a bisecting cut-away view of another embodiment of the adaptor.
Figure 22:
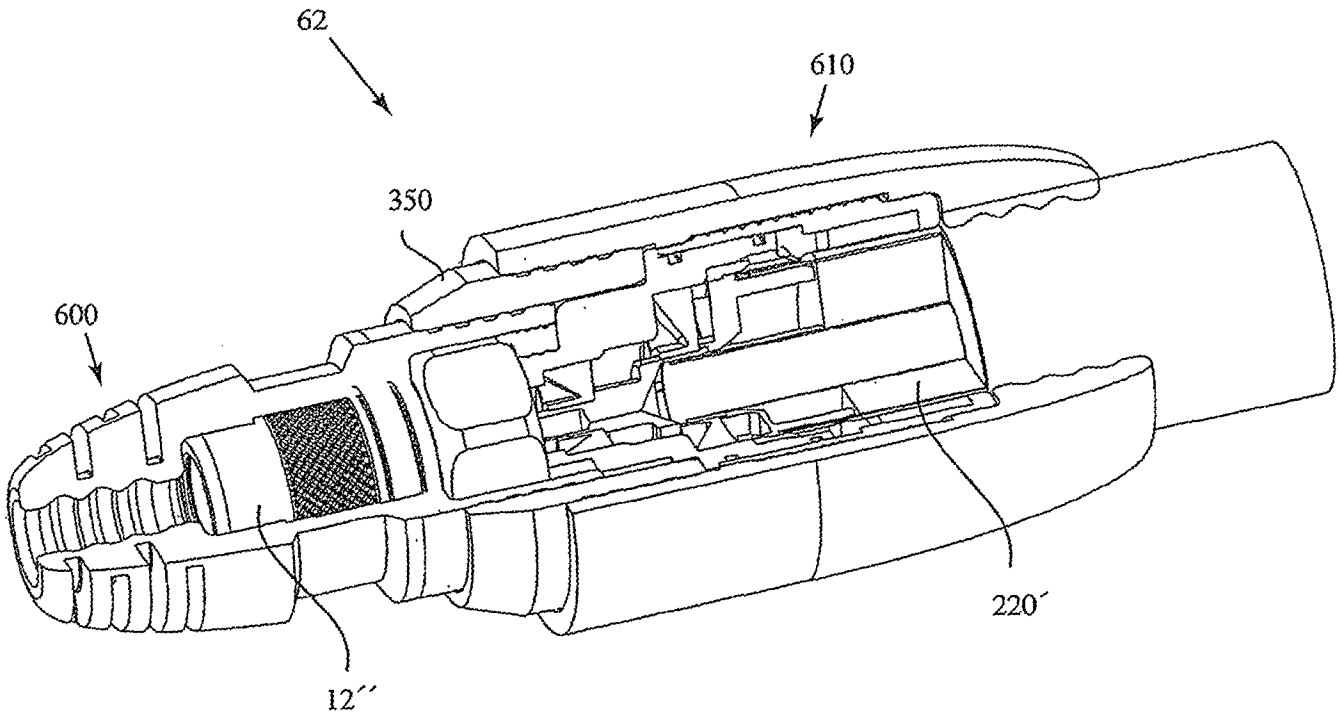
FIG. 22 is a partially cut-away perspective view of a ninth embodiment of a system of covers for providing cover to first and second cable connectors and using an adaptor.
Figure 23:
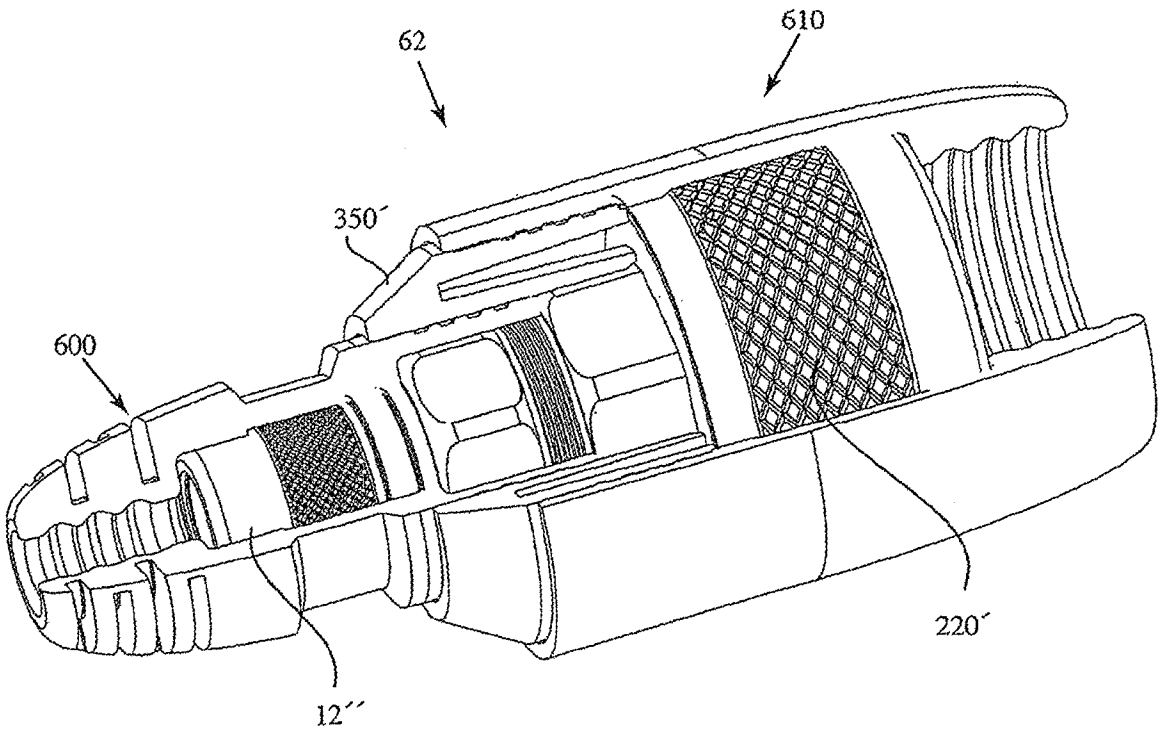
FIGS. 23-25 are partially cut-away perspective views of a tenth embodiment of a system of covers for providing cover to first and second cable connectors and using an adaptor.

FIGS. 21C and 23 show another embodiment of adaptor 350 (hereinafter referred to as 350'). In this embodiment, adaptor 350' comprises: an elongated body composed of a hard plastic material, that extends along a longitudinal axis X-X; a first end 370; and a second end 360. The exterior surface of the adaptor includes a first region 300 that extends from first end 370 to a first shoulder 380, and which is of a serrated cross-section (and thus of continuously fluctuating diameter). In one embodiment of adaptor 350', the diameter of the exterior surface gradually decreases from a maximum diameter at shoulder 380 to a minimum diameter at second end 360. The first end 370 of adaptor 350', however, is structurally different from that of the previous embodiment of the adaptor. The elongated body of adaptor 350' defines a cavity 352 that begins at shoulder 380 and terminates at first end 370. At shoulder 380, the elongated body of the adaptor bifurcates into a larger outer circumferential flexible body 354 and a smaller inner circumferential flexible body 356, which are separated by cavity 352. Additionally, the distance between outer body 354 and inner body 356 (and thus the size of cavity 352) increases gradually from a minimum first distance at shoulder 380 to a maximum distance at first end 370.

Figure 24:
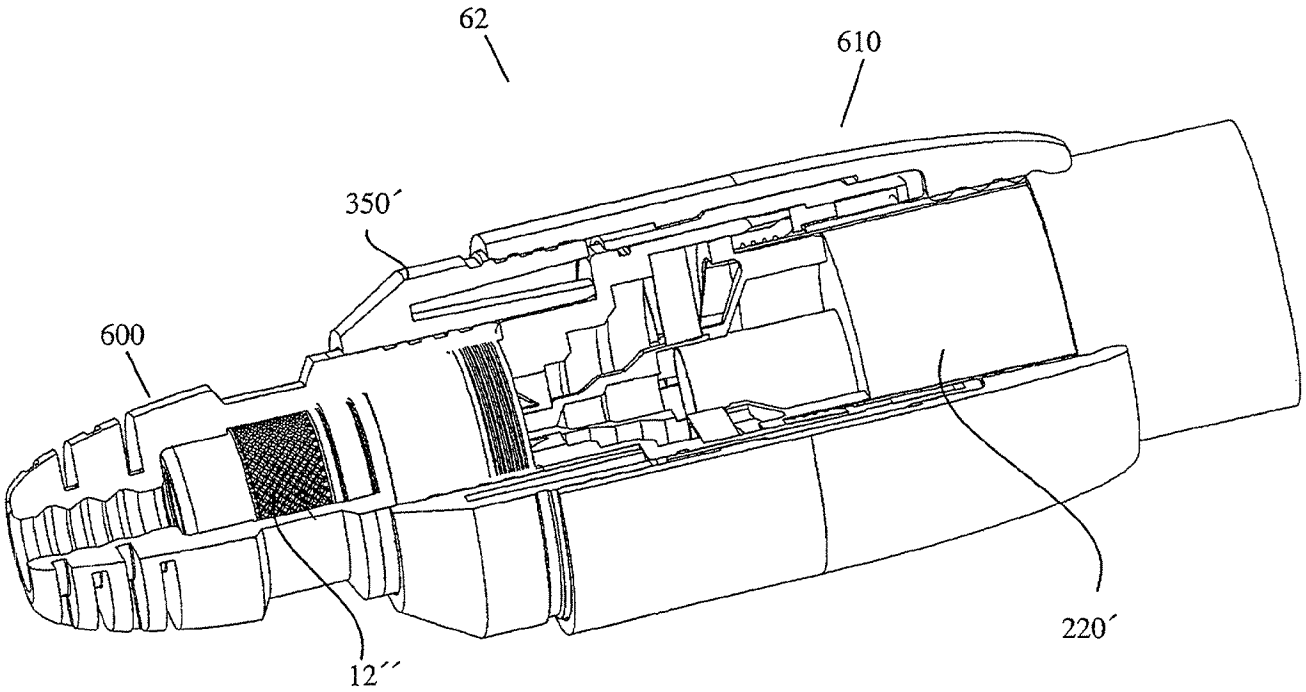

In use, adaptor 350' in FIGS. 21C and 23 serves to fill the space left by two covers of non-interfering dimensions, as described above. The bifurcated structure and cavity of adaptor 350' allows the adaptor to fill a wider variety of gaps using a wider variety of covers. For instance, while some covers will completely encompass the outer serrated surface of adaptor 350' (see, e.g. FIG. 23), other covers will only partially encompass the outer serrated surface of the adaptor (see, e.g. FIG. 24), typically as a result of the underlying cable connectors. Adaptor 350' allows the serrated outer surface to adapt to both configurations. Additionally, if the inner circumference of the connector end of cover 610 is smaller than the outer circumference of adaptor 610, the cavity of the adaptor can be compressed during assembly to allow cover 610 to slide over the adaptor. Adaptor 350' is positioned into the assembled configuration depicted in FIG. 23 as described above.

Figure 26:
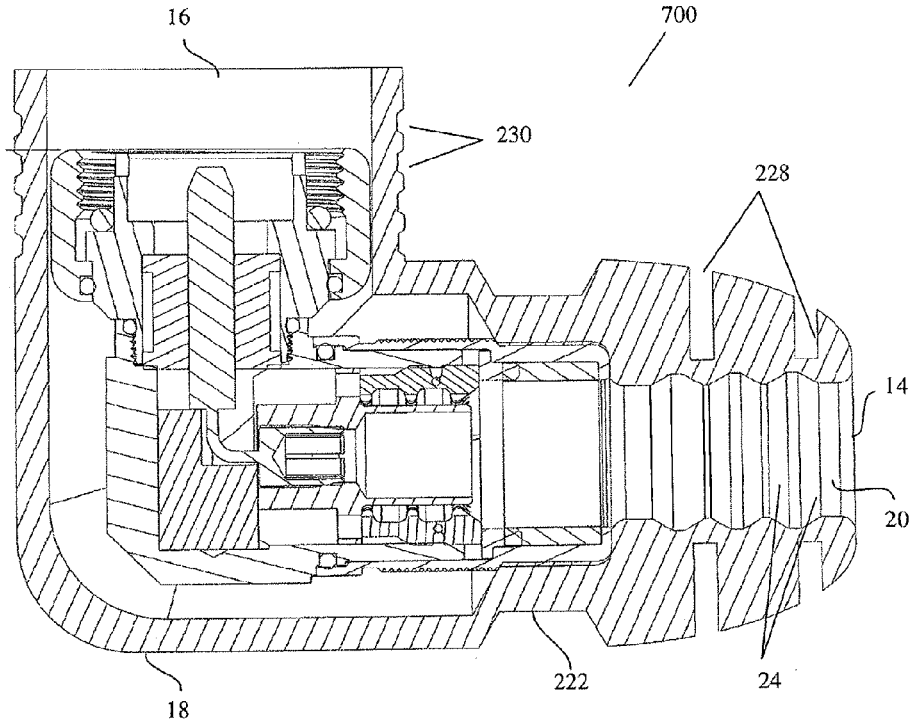
FIG. 26 is a cut-away perspective view of a eleventh embodiment of a cover for a cable connector.

FIG. 26 depicts yet another embodiment of cover 10 adapted to be placed in secure and sealing relation over a connector 12. In this embodiment, cover 10 (hereinafter designated cover 700 to differentiate it from previous embodiments) comprises: an elongated body composed of a flexible material that exhibits a low modulus of elasticity over an extended temperature range, preferably a rubber material, a cable end 14, connector end 16, exterior surface 18, and an interior surface 20.

Figure 25:
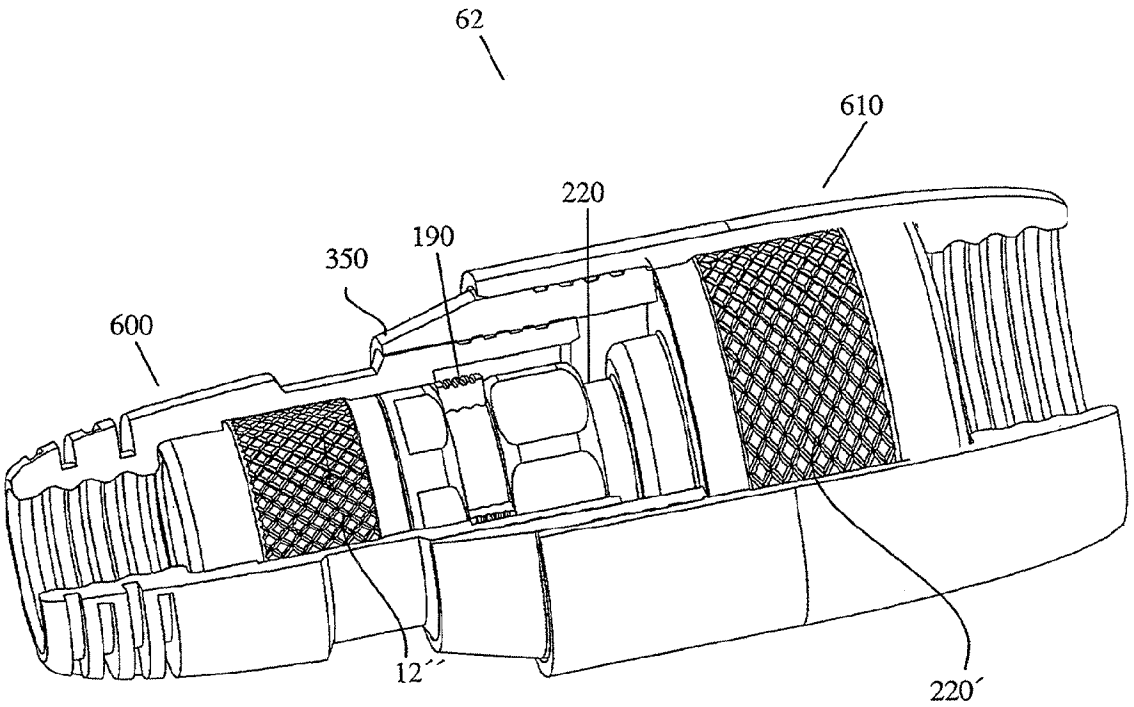

Unlike all previous embodiments in which the cover extends along a longitudinal axis (see, for example, the longitudinal X-X axis in FIG. 1), cover 700 can be designed to cover angled connectors, as shown in FIG. 26. Although the embodiment depicted in FIG. 26 covers hardware positioned such that the axis of cable end 14 and the axis of connector end 16 of cover 700 are at or near a 90° angle respective to one another, it should be noted that any angle greater than or less than a straight 180° angle (as shown in FIG. 25, for example) is possible. Cover 700 can either be designed to be flexible such that it covers all possible angles, or it can be produced to cover hardware of specific or approximate angles.

In one embodiment, cover 700 further comprises an annular groove 222 of reduced diameter (when compared to the other sections of cover 10 as defined below) formed at a medial position in exterior surface 18. The rubber composition of the cover 10 permits it to elastically deform to the connector and other elements that it covers (e.g., the bulkhead), as will be described in greater detail hereinafter, when being installed or removed. In addition, the reduced diameter of medial section 222 provides a suitable gripping area for a gripping tool or fingers when installing cover 10 on a connector 12.

Cover 700 can further comprise a series of longitudinally and sequentially spaced grooves 24 which are formed in interior surface 20, proximate cable end 14, and extend over a predetermined distance. Notably, grooves 24 are not threads as they are not a continuous helix, but rather spaced apart, parallel grooves that function as small reservoirs for any moisture that may infiltrate the open cable end 14 of cover 700. In the field, scratches or other material removal occurs in the jacket of a cable, and moisture may sometimes infiltrate through those scratches and into the seal. Grooves 24 (and the grooves in the other disclosed embodiments) are intended to minimize the effects of any such moisture migration.

Cover 700 can further comprise a plurality of longitudinally spaced strain relief grooves 228 that are formed in exterior surface 18, proximate cable end 14, and extend over a predetermined distance. Each groove 228 extends less than entirely around the circumference of exterior surface 18, although it should be noted that a single strain relief may be suitable in a particular application and the groove could extend entirely around the circumference. In one embodiment, two of the grooves are disconnected from one another by a gap between their ends, and are formed around the circumference of exterior surface in a common plane that extends transverse to a longitudinal axis of the cable end of cover 700. In one embodiment, the strain relief grooves are formed in co-planar pairs around exterior surface 18 and with each pairing extending in laterally spaced, parallel planes to one another.

Cover 700 can also comprise a series of grooves 230 formed entirely circumferentially around exterior surface 18 in spaced, parallel relation to one another. In this embodiment of the present invention, grooves 230 provide reservoirs in which liquid may collect. In one embodiment, grooves 230 provide pressure points to engage or otherwise frictionally interact with grooves on the inner surface of another cover.

Figure 27:
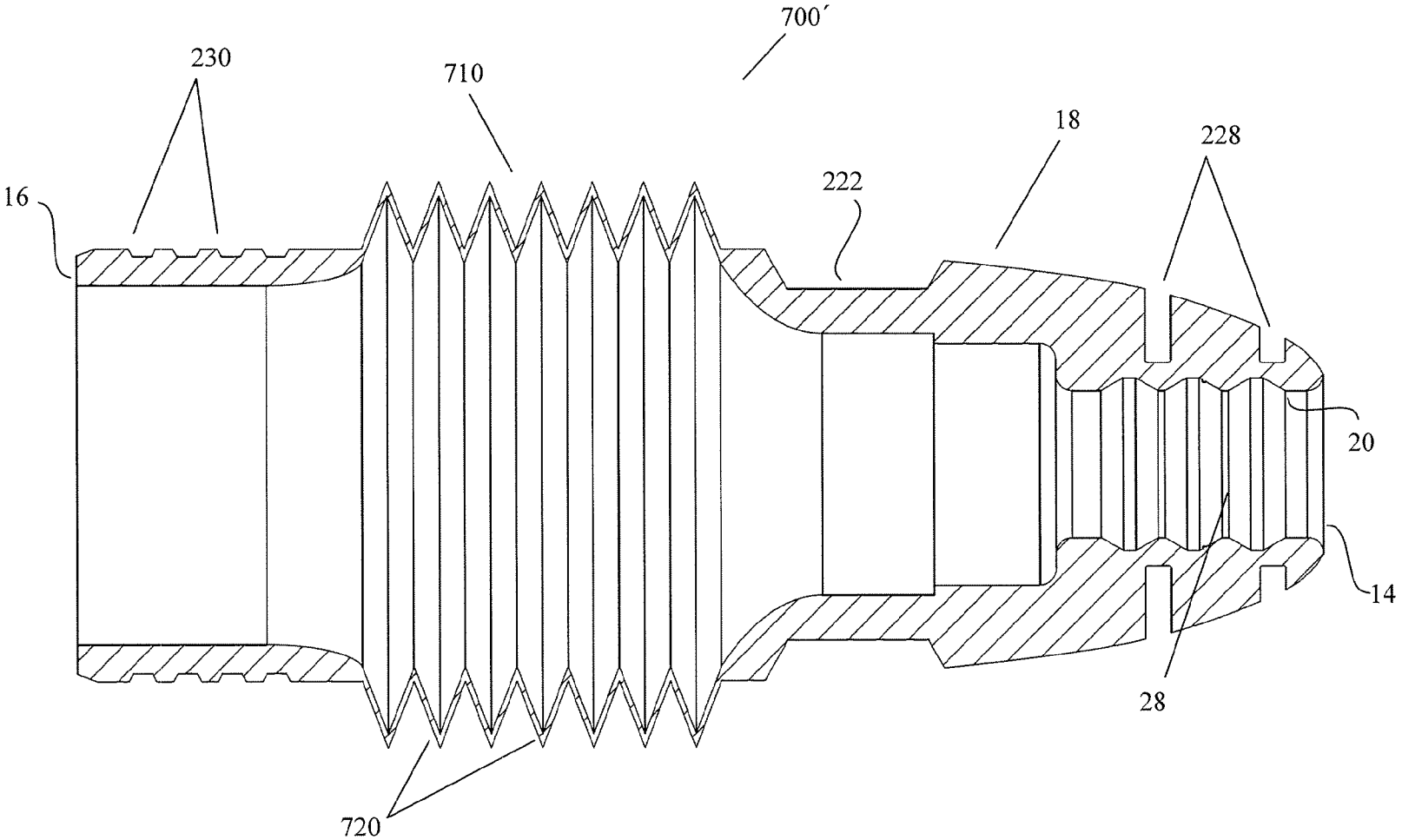
FIG. 27 is a cut-away side view of a twelfth embodiment of a cover for a cable connector prior to installation.

FIG. 27 depicts another embodiment of cover 700 adapted to be placed in secure and sealing relation over a connector. In this embodiment, cover 700 (hereinafter designated cover 700' to differentiate it from the previous embodiment) comprises: an elongated body composed of a flexible material that exhibits a low modulus of elasticity over an extended temperature range, preferably a rubber material, a cable end 14, connector end 16, exterior surface 18, and an interior surface 20.

Figure 28:
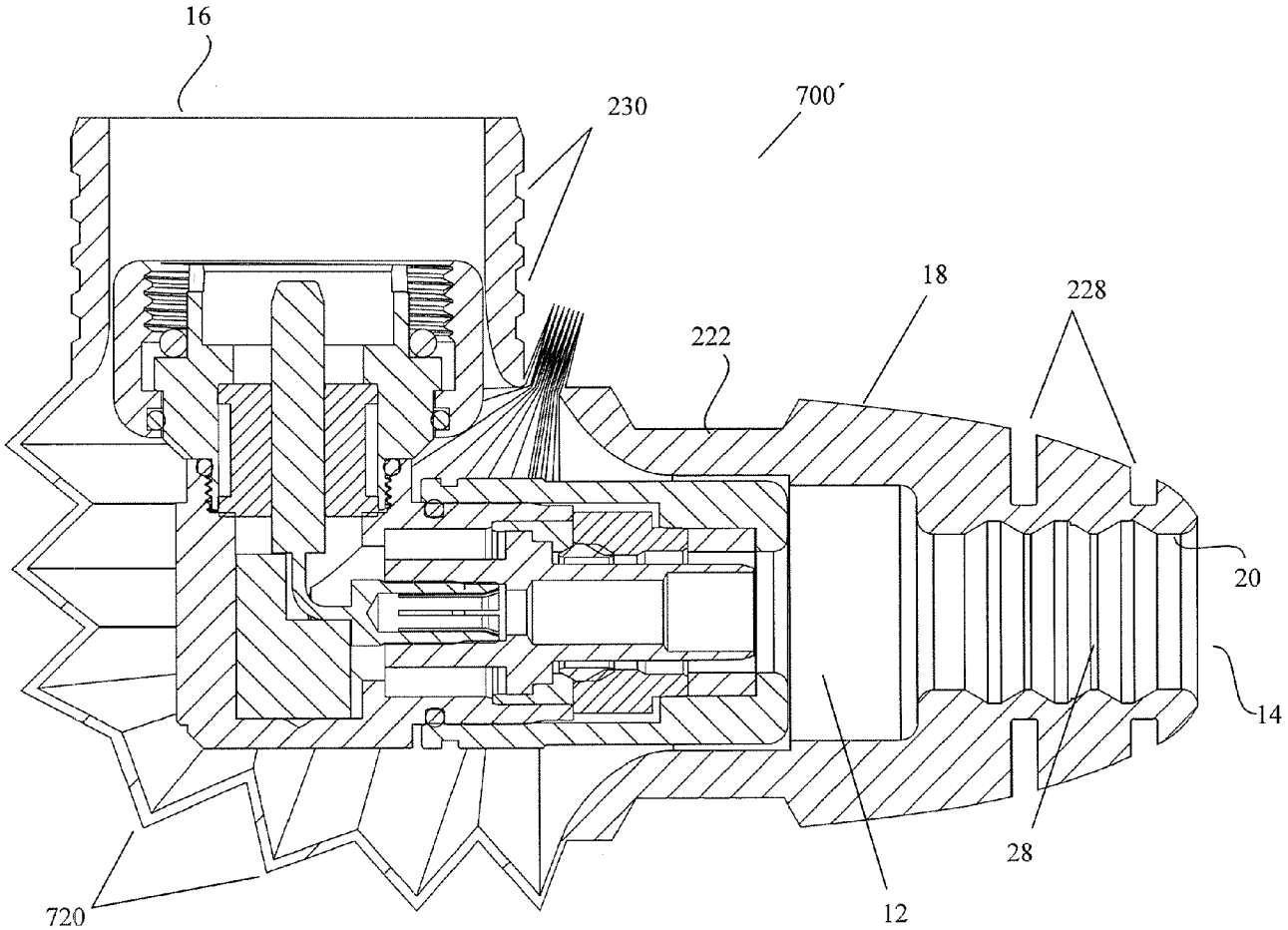
FIG. 28 is a cut-away side view of the same embodiment of the cover, after installation over a connector.

Unlike previous embodiments in which the cover extends along a longitudinal axis after installation (see, for example, the longitudinal X-X axis in FIG. 1), cover 700' is designed to cover an angled connector, such as the angled connector 12 shown in FIG. 28. Cover 700' includes a flexible region denoted generally as region 710. Region 710 region comprises a series of circumferential accordion-like folds 720 that, prior to installation over a connector, are transverse to the longitudinal X-X axis and provide maximum flexibility to the cover. Each of folds 720 can be compressed inward such that the body of the cover decreases in length, or can be expanded outward such that the body of the cover increases in length. Additionally, each of the circumferential accordion-like folds can be manipulated by the user/installer such that one region of a single fold is compressed while another region of the same fold is expanded. To further facilitate the increased flexibility, the thickness of the walls of cover 700' at region 710 can be reduced compared to other regions of the cover.

Due to the flexibility of region 710, the cover is capable of bending in a number of different directions, with each of the accordion-like folds expanding and/or compressing depending on the particular angle of the connector. FIG. 28, for example, shows cover 700' after installation over a connector 12. Although FIG. 28 depicts cover 700' adapted to cover a connector with a specific predetermined angle, it should be noted that cover 700' can be designed to be sufficiently flexible to cover a connector or other component having any specific predetermined angle.

Similar to the previous embodiment, cover 700' can further comprise an annular groove 222 of reduced diameter (when compared to the other outer regions of the cover) formed at a medial position in exterior surface 18. The reduced diameter of medial section 222 provides a suitable gripping area for a gripping tool or fingers when installing the cover on a connector or other component.

Cover 700' can further comprise a series of longitudinally and sequentially spaced grooves 24 which are formed in interior surface 20, proximate cable end 14, and extend over a predetermined distance. Notably, grooves 24 are not threads as they are not a continuous helix, but rather spaced apart, parallel grooves that function as small reservoirs for any moisture that may infiltrate the open cable end 14 of cover 700'. In the field, scratches or other material removal occurs in the jacket of a cable, and moisture may sometimes infiltrate through those scratches and into the seal. Grooves 24 (and the grooves in the other disclosed embodiments) are intended to minimize the effects of any such moisture migration.

Cover 700' can further comprise a plurality of longitudinally spaced strain relief grooves 228 that are formed in exterior surface 18, proximate cable end 14, and extend over a predetermined distance. Each groove 228 extends less than entirely around the circumference of exterior surface 18, although it should be noted that a single strain relief may be suitable in a particular application and the groove could extend entirely around the circumference. In one embodiment, two of the grooves are disconnected from one another by a gap between their ends, and are formed around the circumference of exterior surface in a common plane that extends transverse to a longitudinal axis of the cable end of cover 700'. In one embodiment, the strain relief grooves are formed in co-planar pairs around exterior surface 18 and with each pairing extending in laterally spaced, parallel planes to one another.

Cover 700' can also comprise a series of grooves 230 formed entirely circumferentially around exterior surface 18 in spaced, parallel relation to one another. In this embodiment of the present invention, grooves 230 provide reservoirs in which liquid may collect. In one embodiment, grooves 230 provide pressure points to engage or otherwise frictionally interact with grooves on the inner surface of another cover.

Although not shown, angled covers 700 and 700' can also be employed in a multi-cover system. According to this system the angled cover and a second cover, which is, for example, one of the embodiments described herein or another cable cover known in the art, both splice cables which terminate at a connector. The angled cover slides over and covers at least a portion of the second cover (or vice versa). In addition to forming a protective seal, the interference fit between the interior surface of the outer cover and the grooves on the exterior surface of the inner cover inhibits removal of either cover without the application of force specifically directed toward disassembling the assembly. Furthermore, having the plurality of grooves in the exterior provides redundancy in terms of inhibiting moisture migration; if one of the peaks forming grooves is sliced or otherwise compromised, moisture may infiltrate and reside in the valley of that groove (i.e., each valley provides a successive reservoir for moisture containment).

Figure 29:
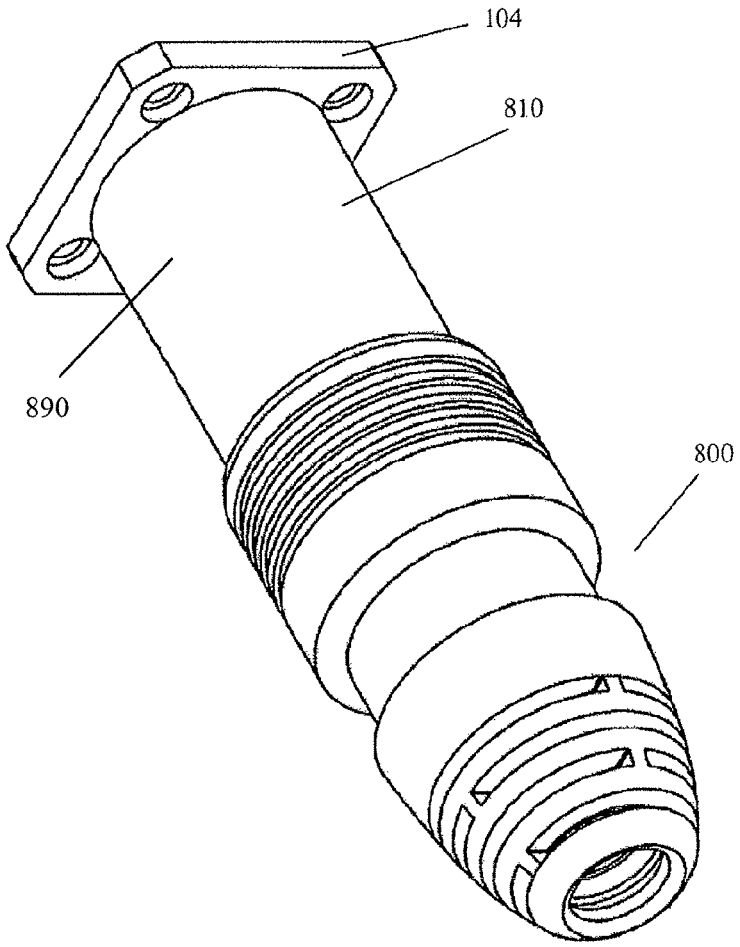
FIG. 29 is a side view of a system comprising a cable cover and a port seal of customizable length.

FIG. 29 depicts another embodiment of a cover system 64. In FIG. 29, system 64 uses cover 800 which is adapted to envelop a connector that terminates in a bulkhead 104. The structure of cover 800 can be the same as or similar to any of the cover embodiments described above. While the structure of cover 800 may be the same as described above, the method of use and resultant arrangement is different.

Figure 30:
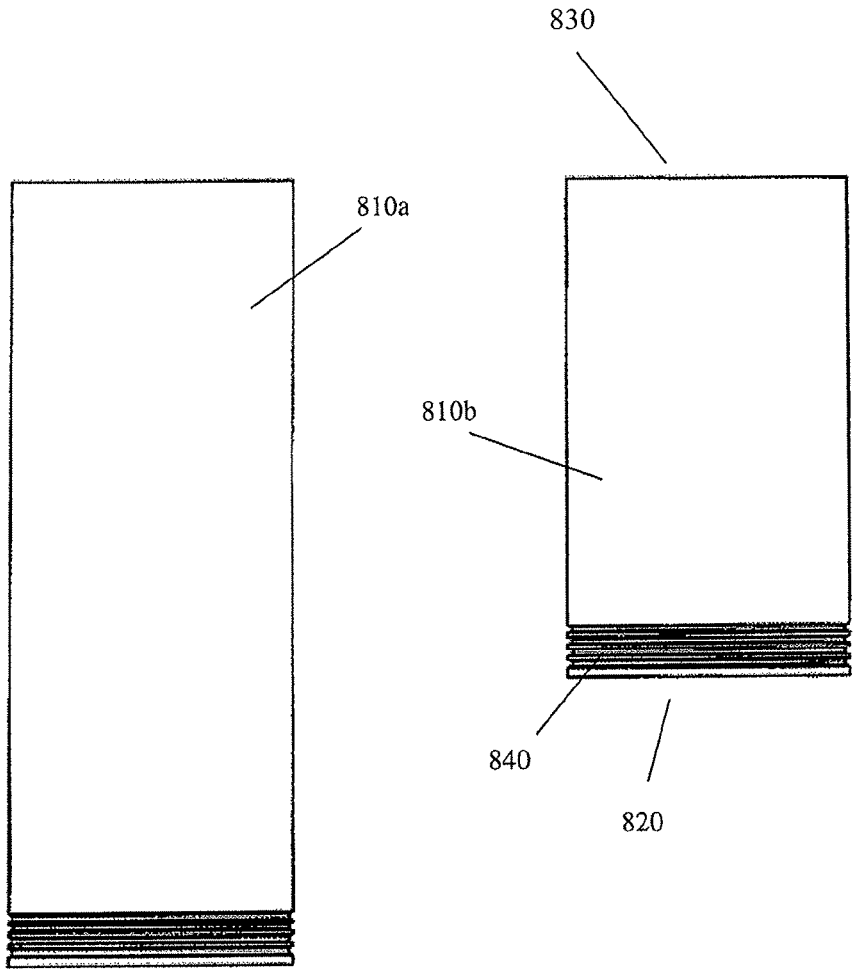
FIG. 30 is a side view of two port seals of different lengths according to one embodiment of the present invention.

In addition to cover 800, system 64 in FIG. 29 further comprises a customizable port seal 810 with an elongated body which has a cable end 820 and a connector or bulkhead end 830 (shown, for example, in FIG. 30). The port seal is designed to cover a port or connector (shown, for example, in FIGS. 1-7) that extends from bulkhead 104. Similar to the covers, port seal 810 protects the underlying hardware from exposure to moisture and other environmental factors. Since ports and connectors can vary in length, it is desirable to have a versatile port seal system which can adapt to various port sizes. Thus, connector or bulkhead end 830 of port seal 810 can be customized to the desired length and then installed onto the port to form a waterproof seal. Removal can be accomplished by a variety of means, including, for example, cutting the port seal to the desired length.

Thus, the customizable port seal comprises an elongated body that has an initial starting length, and a section near the connector end (see, for example, region 890 in FIG. 29) that is designed to be customizable. At least a portion of section 890 is removable such that the port seal has a post-customization length short than the initial starting length (see, for example, the before and after customization depicted in FIG. 30).

Customizable port seal 810 can be adapted to different lengths prior to being slid onto the hardware component, or, when used in a system similar to system 64 in FIG. 29, the port seal can be adapted to different lengths prior to interacting with cable cover 800.

Figure 31:
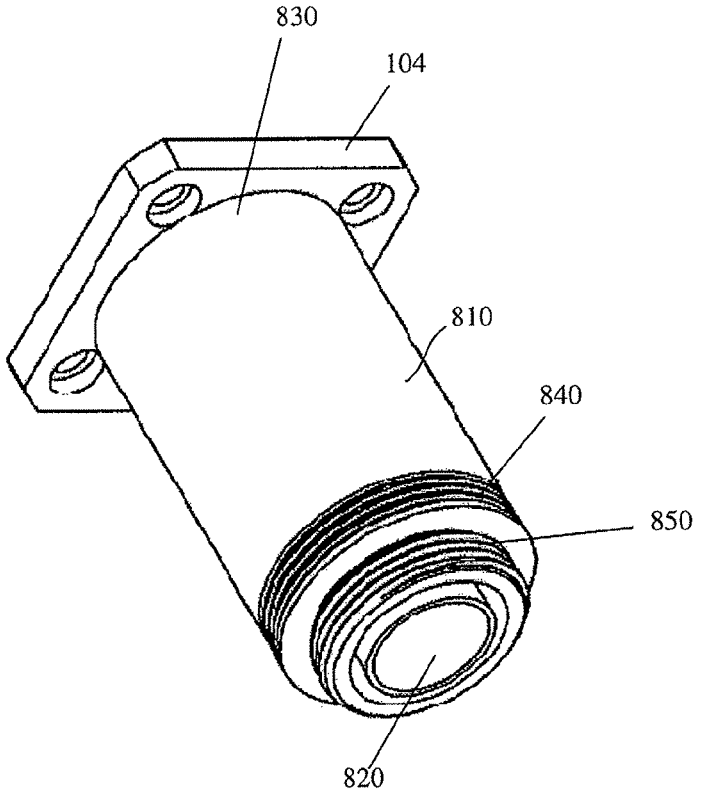
FIG. 31 is a perspective view of a bulkhead with a port seal.
Figure 32:
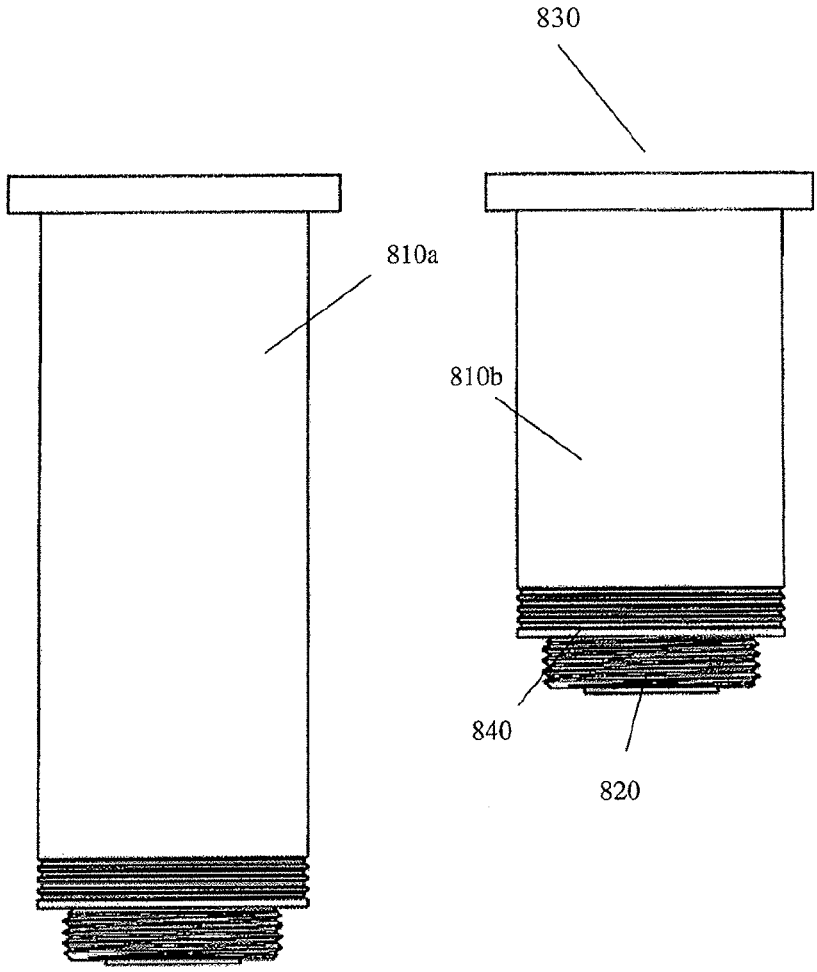
FIG. 32 is a side view of two port seals of different lengths according to one embodiment of the present invention.
Figure 33:
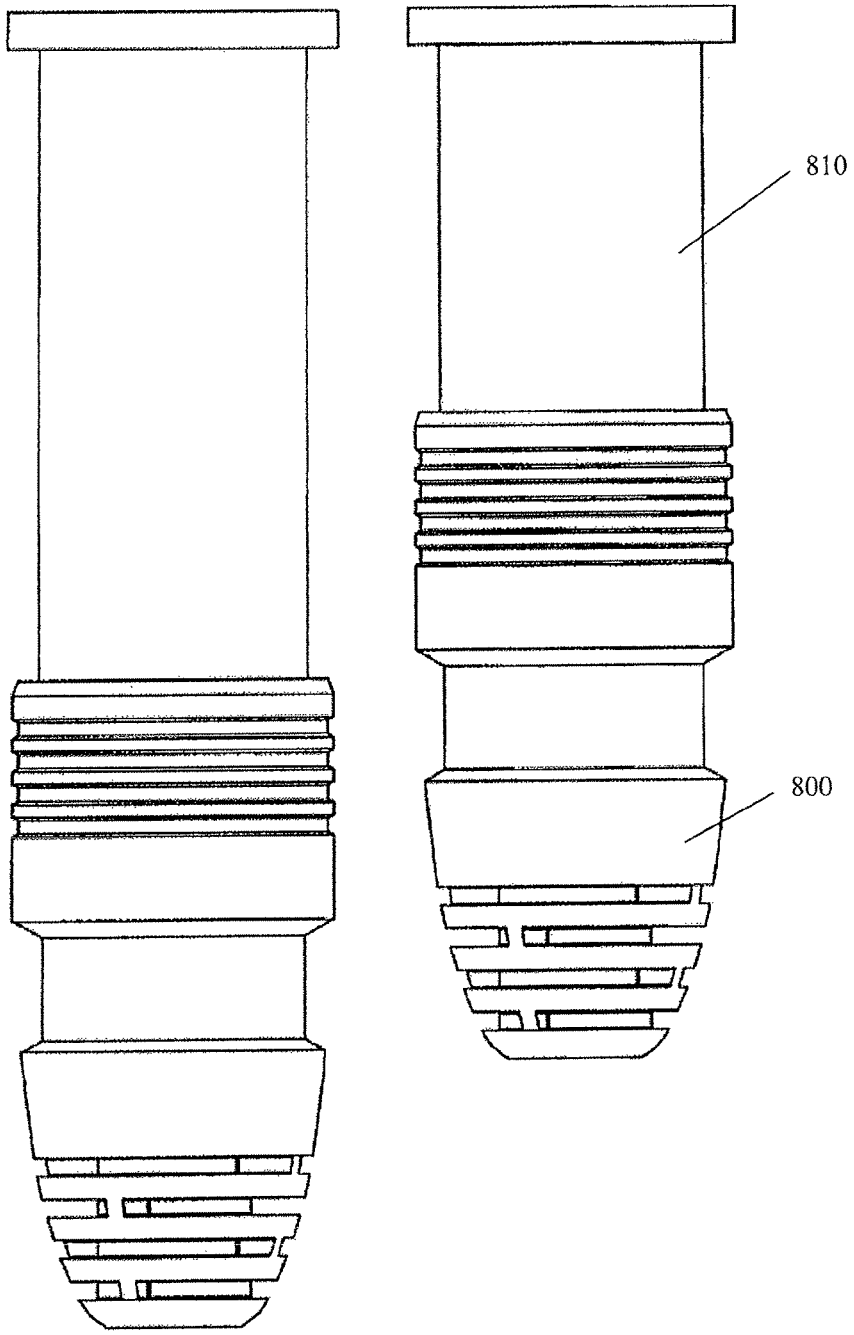
FIG. 33 is a side view of two port seals of different lengths with cable covers.

To use cover system 64, port seal 810 is customized to the proper length and slid entirely over the hardware such as a cable connector. Cover 800 is then slid at least partially over the cable end of port seal 810, thereby creating a seal and moisture barrier between the interior surface of the connector end of cover 800 and the exterior surface of the cable end of the port seal. Cable end 820 of port seal 810 in FIG. 30, for example, comprises a series of longitudinally and sequentially spaced grooves 840 which extend over a predetermined distance. Notably, grooves 840 are not threads as they are not a continuous helix, but rather spaced apart, parallel grooves that function as small reservoirs for any moisture that may infiltrate the open cable end 820 of the port seal. In the field, scratches or other material removal occurs in the jacket of a cable, and moisture may sometimes infiltrate through those scratches and into the seal. Grooves 840 (and the grooves in the other disclosed embodiments) are intended to minimize the effects of any such moisture migration. The port seal in FIG. 30 further comprises a secondary ring 850 at the cable end which has a smaller diameter than the larger ring comprising grooves 840. Indeed, the end of the port seal can be designed according to any method or design as is needed or as is known in the art. This embodiment of the customizable port seal 810 is further depicted in FIG. 31, which shows an example of port seal of adjusted length. Although both port seals may have been produced to be the same length, port seal 810*b* was adjusted to be a shorter length to cover/seal a shorter connector. In FIG. 33, covers have been placed over the variable-length port seals.

Figure 34:
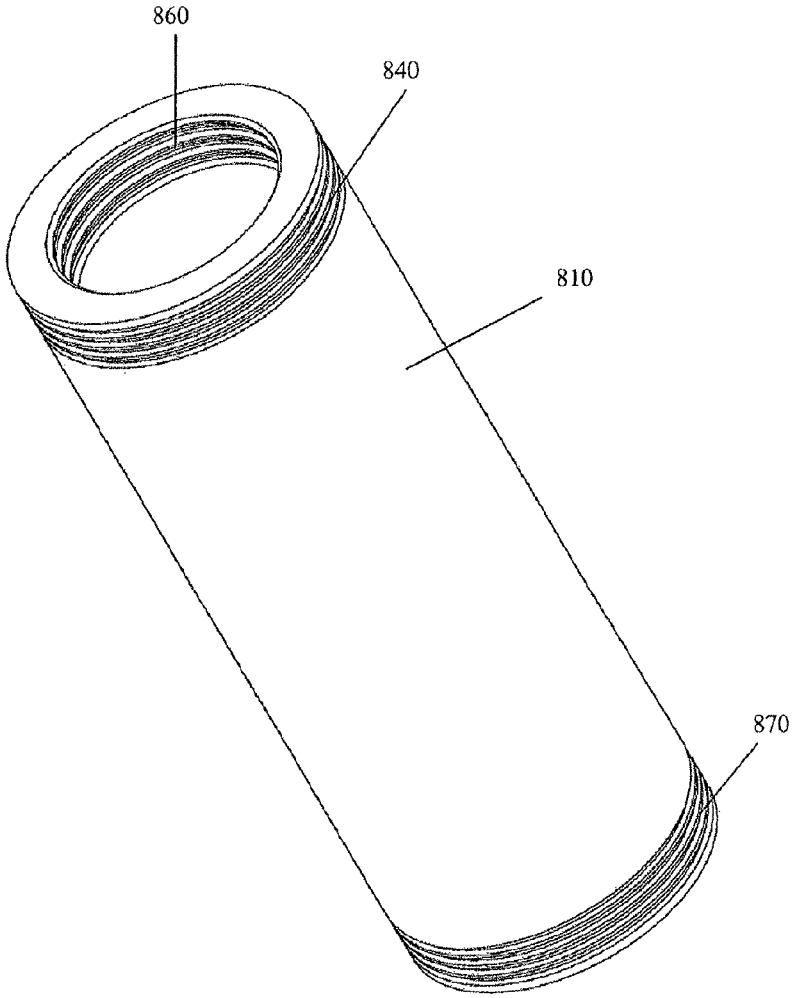
FIG. 34 is a perspective view of an adjustable port seal.
Figure 35:
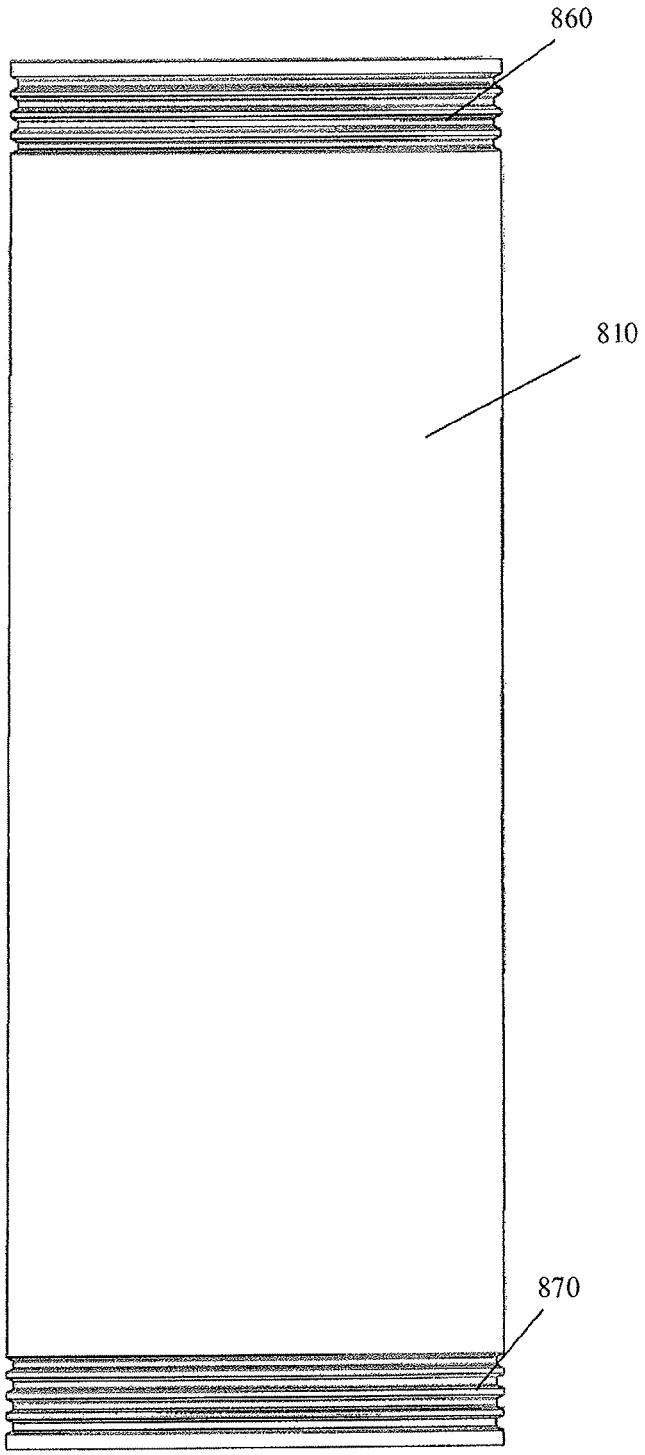
FIG. 35 is a side view of an adjustable port seal.

FIGS. 34 and 35 depict another embodiment of port seal 810. Similar to the previous embodiments, the port seal comprises a series of longitudinally and sequentially spaced grooves 840 which extend over a predetermined distance. Notably, grooves 840 are not threads as they are not a continuous helix, but rather spaced apart, parallel grooves that function as small reservoirs for any moisture that may infiltrate the open cable end 820 of the port seal. In the field, scratches or other material removal occurs in the jacket of a cable, and moisture may sometimes infiltrate through those scratches and into the seal. Grooves 840 (and the grooves in the other disclosed embodiments) are intended to minimize the effects of any such moisture migration. In this embodiment, the port seal comprises a second set of exterior grooves 870 on the opposite end of the seal. The port seal in FIGS. 34 and 35 also comprises an additional set of grooves 860 on the interior surface of one or both ends of the port seal. These additional grooves create an additional environmental barrier.

Although several embodiments of the present invention have been specifically described herein, the full scope and spirit of the present invention is not to be limited thereby, but instead extends to the metes and bounds as defined by the appended claims.

What is claimed is:

1. A port seal system, comprising:

a port seal comprising a unitary elongated body having an initial length, said unitary elongated body comprising a cable end, a connector end, an interior surface, and an exterior surface, and a first section of arbitrary length proximate said connector end, wherein at least a portion of said first section is adapted to be removed such that said unitary elongated body has a second, post-removal length which is shorter than said initial length; and a cover adapted for placement in overlapping communication with said cable end of said port seal, said cover comprising a unitary elongated body member having a cable end, a connector end, an interior surface, and an exterior surface, and a plurality of spaced apart grooves formed in a predetermined region of said interior surface of said body member that is proximate said cable end.

2. The port seal system of claim 1, wherein each of said plurality of grooves extends in spaced parallel relation to the others.

3. The port seal system of claim 1, wherein said exterior surface of said cover comprises a first region extending from said cable end to a first shoulder and including at least one strain relief member defined therein, said first region having a minimum, first cross-sectional diameter, a second region extending from said first shoulder to a second shoulder, the second region having a minimum, second cross-sectional diameter that is less than said minimum, first cross-sectional diameter, and a third region extending from said second shoulder to said connector end, said third region having a minimum, third cross-sectional diameter that is greater than said minimum, second cross-sectional diameter.

4. The port seal system of claim 3, wherein each of said at least one strain relief members comprises a circumferential grooves extending less than completely around the circumference of said first region of the exterior surface.

* * * * *